US010384447B2

(12) United States Patent
Kobayashi et al.

(10) Patent No.: US 10,384,447 B2
(45) Date of Patent: Aug. 20, 2019

(54) LIQUID EJECTION HEAD AND RECORDING DEVICE

(71) Applicant: KYOCERA Corporation, Kyoto-shi, Kyoto (JP)

(72) Inventors: Naoki Kobayashi, Kirishima (JP); Hiroyuki Kawamura, Kirishima (JP); Wataru Ikeuchi, Kirishima (JP)

(73) Assignee: Kyocera Corporation, Kyoto (JP)

( * ) Notice: Subject to any disclaimer, the term of this patent is extended or adjusted under 35 U.S.C. 154(b) by 0 days.

(21) Appl. No.: 15/771,813

(22) PCT Filed: Oct. 27, 2016

(86) PCT No.: PCT/JP2016/081885
§ 371 (c)(1),
(2) Date: Apr. 27, 2018

(87) PCT Pub. No.: WO2017/073668
PCT Pub. Date: May 4, 2017

(65) Prior Publication Data

US 2018/0319162 A1 Nov. 8, 2018

(30) Foreign Application Priority Data

Oct. 29, 2015 (JP) ..... 2015-213297

(51) Int. Cl.
*B41J 2/14* (2006.01)

(52) U.S. Cl.
CPC ..... *B41J 2/14056* (2013.01); *B41J 2/14048* (2013.01); *B41J 2/14072* (2013.01); (Continued)

(58) Field of Classification Search
CPC ..... B41J 2/14056; B41J 2/14072; B41J 2/14274; B41J 2/14048; B41J 2/14209; (Continued)

(56) References Cited

U.S. PATENT DOCUMENTS

2013/0076836 A1 3/2013 Yokota
2014/0125378 A1* 5/2014 Kim ..... H03K 19/173 326/41

FOREIGN PATENT DOCUMENTS

EP 2783857 A2 10/2014
JP 2013-071293 A 4/2013

OTHER PUBLICATIONS

IP.com search (Year: 2019).*

* cited by examiner

*Primary Examiner* — Lisa Solomon
(74) *Attorney, Agent, or Firm* — Volpe and Koenig, P.C.

(57) ABSTRACT

In a liquid ejection head, an ejection unit of a channel member includes an ejection hole, a pressurizing chamber connected to the ejection hole, a first channel and a second channel each connecting the pressurizing chamber and a first common channel, and a third channel connecting the pressurizing chamber and a second common channel. The first common channel, in the channel direction, includes a plurality of first portions, and a plurality of second portions each located between each two of the plurality of first portions and having smaller cross-sectional areas than those of the first portions in front and back of the same. In each of the plurality of ejection units, the first channel and the second channel are individually connected to two positions in the first common channel which sandwich at least one of the second portions between them.

20 Claims, 17 Drawing Sheets

(52) U.S. Cl.
CPC ..... *B41J 2/14209* (2013.01); *B41J 2/14274* (2013.01); *B41J 2002/14419* (2013.01); *B41J 2002/14459* (2013.01); *B41J 2002/14491* (2013.01); *B41J 2202/12* (2013.01); *B41J 2202/21* (2013.01)

(58) Field of Classification Search
CPC ..... B41J 2202/21; B41J 2002/14491; B41J 2002/14459; B41J 2002/14419; B41J 2202/12
See application file for complete search history.

LIQUID EJECTION HEAD AND RECORDING DEVICE

TECHNICAL FIELD

The present disclosure relates to a liquid ejection head and a recording device.

BACKGROUND ART

Conventionally, as a printing head, for example there is known a liquid ejection head performing various types of printing by ejecting liquid onto a recording medium. The liquid ejection head has formed therein a channel member having channels in which liquid flows. The channel member has a common channel and a plurality of ejection units connected to the common channel. Each ejection unit has an individual channel connected to the common channel, a pressurizing chamber connected to the individual channel, and an ejection hole connected to the pressurizing chamber. By pressurization of the pressurizing chamber, liquid is ejected from the ejection hole. The liquid to the pressurizing chamber is supplied from the common channel. Further, there is known the technique of recovering the liquid from the pressurizing chambers at the common channel and circulating the liquid. As the configurations of the common channel and individual channels, various ones have been proposed.

For example, Patent Literature 1 discloses an embodiment providing one dual-purpose common channel both supplying and recovering the liquid and a plurality of ejection units connected to this. In this embodiment, each ejection unit has one supply-use individual channel which connects the dual-purpose common channel and the pressurizing chamber and is utilized for supply of the liquid to the pressurizing chamber and one recovery-use individual channel which connects the dual-purpose common channel and the pressurizing chamber and is utilized for recovery of the liquid from the pressurizing chamber.

CITATION LIST

Patent Literature

Patent Literature 1: Japanese Patent Publication No. 2013-71293A

SUMMARY OF INVENTION

One embodiment of a liquid ejection head in the present disclosure includes a channel member including a first common channel and a second common channel which extend parallel to each other, and a plurality of ejection units aligned along them, wherein each of the plurality of ejection units includes an ejection hole, a pressurizing chamber connected to the ejection hole, a first channel and a second channel each connecting the pressurizing chamber and the first common channel, and a third channel connecting the pressurizing chamber and the second common channel; and a plurality of pressurizing parts individually pressurizing the plurality of pressurizing chambers. A first opening on a first common channel side of the first channel and a second opening on a first common channel side of the second channel are spaced apart from each other in a channel direction of the first common channel by a length not less than a width of the first common channel at a position in the first opening.

Another embodiment of a liquid ejection head in the present disclosure includes a channel member including a first common channel and a second common channel which extend parallel to each other, and a plurality of ejection units aligned along them, wherein each of the plurality of ejection units includes an ejection hole, a pressurizing chamber connected to the ejection hole, a first channel and a second channel each connecting the pressurizing chamber and the first common channel, and a third channel connecting the pressurizing chamber and the second common channel; and a plurality of pressurizing parts individually pressurizing the plurality of pressurizing chambers. An angle formed by a first opening on a first common channel side of the first channel and a second opening on a first common channel side of the second channel is 135 degrees or less.

Still another embodiment of a liquid ejection head in the present disclosure includes a channel member including a first common channel and a second common channel which extend parallel to each other, and a plurality of ejection units aligned along them, wherein each of the plurality of ejection units includes an ejection hole, a pressurizing chamber connected to the ejection hole, a first channel and a second channel each connecting the pressurizing chamber and the first common channel, and a third channel connecting the pressurizing chamber and the second common channel; and a plurality of pressurizing parts individually pressurizing the plurality of pressurizing chambers. The first common channel, in the channel direction, includes a plurality of first portions, and a plurality of second portions individually located between each two of the plurality of first portions and having smaller cross-sectional areas than those of the first portions in front and back of the same. In each of the plurality of ejection units, the first channel and the second channel are individually connected to two positions in the first common channel which sandwich at least one of the second portions between them.

An embodiment of a recording device in the present disclosure includes a liquid ejection head described above, a conveying part which conveys the recording medium with respect to the liquid ejection head, and a control part controlling the liquid ejection head.

BRIEF DESCRIPTION OF DRAWINGS

FIGS. 3 FIG. 3A is a perspective view of the liquid ejection head in FIG. 2.

FIGS. 4 FIG. 4A is a disassembled perspective view of a head body.

FIGS. 5 FIG. 5A is a plan view of the head body when viewed through a portion of the second channel member.

FIGS. 7 FIG. 7A is a perspective view of an ejection unit.

FIGS. 8 FIG. 8A is a cross-sectional view along the VIIIa-VIIIa line in FIG. 7B.

FIGS. 16 FIG. 16A is a perspective view of an ejection unit according to a second embodiment.

DESCRIPTION OF EMBODIMENTS

First Embodiment (Overall Configuration of Printer)

Figure 1A:
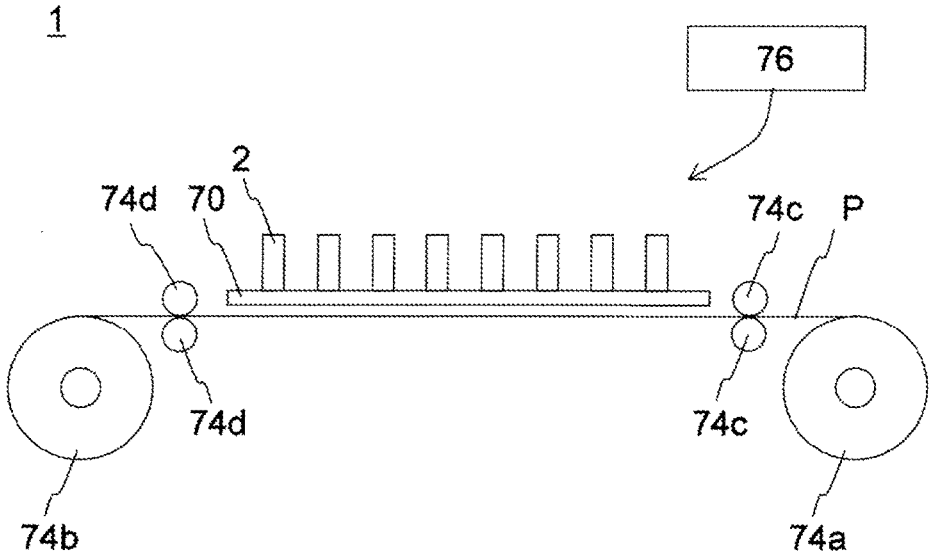
FIG. 1A is a side view schematically showing a recording device including a liquid ejection head according to a first embodiment.

Using FIG. 1, a color inkjet printer 1 (below, referred to as a "printer 1") including a liquid ejection head 2 according to a first embodiment will be explained.

The printer 1 conveys a recording medium P from a conveying roller 74*a* to a conveying roller 74*b* to make the recording medium P move relative to the liquid ejection heads 2. A control part 76 controls the liquid ejection heads 2 based on image or text data to make them eject liquid toward the recording medium P and shoot droplets onto the recording medium P to thereby perform printing on the recording medium P.

In the present embodiment, the liquid ejection heads 2 are fixed with respect to the printer 1, so the printer 1 becomes a so-called line printer. As another embodiment of the recording device, there can be mentioned a so-called serial printer.

To the printer 1, a plate-shaped head mounting frame 70 is fixed so that it becomes substantially parallel to the recording medium P. The head mounting frame 70 is provided with 20 holes (not shown). Twenty liquid ejection heads 2 are mounted in the holes. Five liquid ejection heads 2 configure one head group 72, and the printer 1 has four head groups 72.

Figure 1B:
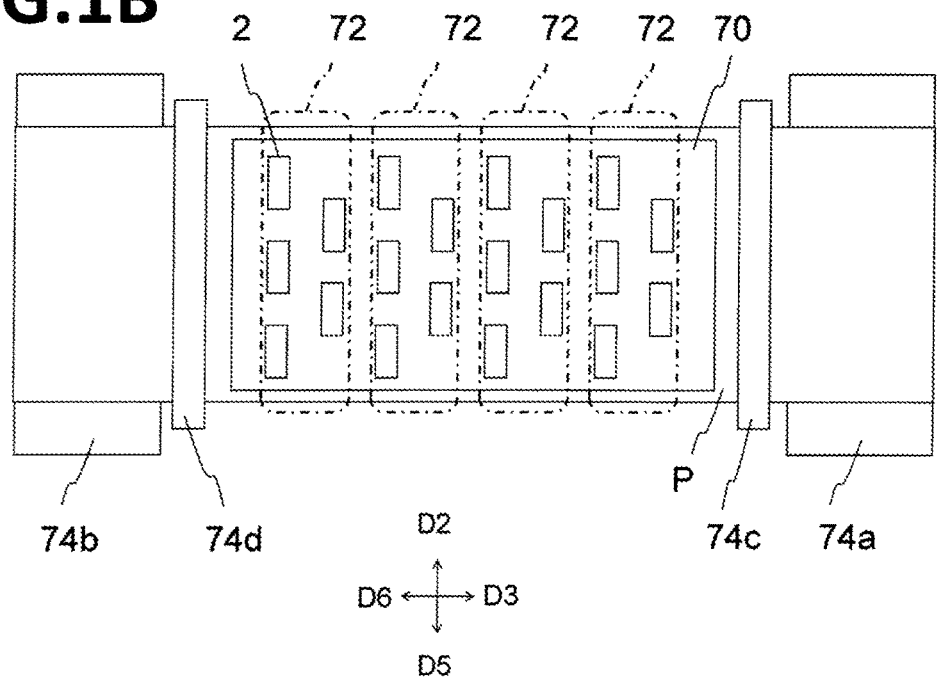
FIG. 1B is a plan view schematically showing a recording device including a liquid ejection head according to the first embodiment.

A liquid ejection head 2 has an elongated long shape as shown in FIG. 1B. In one head group 72, three liquid ejection heads 2 are aligned in a direction crossing the conveying direction of the recording medium P. The other two liquid ejection heads 2 are aligned at positions offset along the conveying direction so that each is arranged between two among the three liquid ejection heads 2. The adjacent liquid ejection heads 2 are arranged so that ranges which can be printed by the liquid ejection heads 2 are connected in the width direction of the recording medium P or the ends overlap each other, therefore printing without a gap becomes possible in the width direction of the recording medium P.

The four head groups 72 are arranged along the conveying direction of the recording medium P. To each liquid ejection head 2, ink is supplied from a not shown liquid tank. To the liquid ejection heads 2 belonging to one head group 72, ink of the same color is supplied. Inks of four colors are printed by the four head groups 72. The colors of inks ejected from the head groups 72 are for example magenta (M), yellow (Y), cyan (C), and black (K).

Note that, the number of liquid ejection heads 2 mounted in the printer 1 may be one as well so far as printing is carried out for a range which can be printed by one liquid ejection head 2 in a single color. The number of liquid ejection heads 2 included in the head group 72 or the number of head groups 72 can be suitably changed according to the target of printing or printing conditions. For example, the number of head groups 72 may be increased as well in order to perform printing by further multiple colors. Further, by arranging a plurality of head groups 72 for printing in the same color and alternately performing printing in the conveying direction, the printing speed, that is, the conveying speed, can be made faster. Further, it is also possible to raise the resolution in the width direction of the recording medium P by preparing a plurality of head groups 2 for printing in the same color and arranging them offset in a direction crossing the conveying direction.

Further, other than printing colored inks, a coating agent or other liquid may be printed as well in order to treat the surface of the recording medium P.

The printer 1 performs printing on the recording medium P. The recording medium P is in a state wound around the conveying roller 74*a*. After passing between the two conveying rollers 74*c*, it passes under the liquid ejection heads 2 mounted in the head mounting frame 70. After that, it passes between the two conveying rollers 74*d* and is finally collected by the conveying roller 74*b*.

The recording medium P may be a fabric or the like other than printing paper. Further, the printer 1 may be formed so as to convey a conveyor belt in place of the recording medium P, and the recording medium may be, other than a rolled one, a sheet, cut fabric, wood, tile, etc. which are placed on the conveyor belt as well. Further, a liquid containing conductive particles may be ejected from the liquid ejection heads 2 to print a wiring pattern etc. of an electronic apparatus as well. Furthermore, predetermined amounts of liquid chemical agents or liquids containing chemical agents may be ejected from the liquid ejection heads 2 toward a reaction vessel or the like to cause a reaction etc. and thereby prepare pharmaceutical products.

Further, a position sensor, speed sensor, temperature sensor etc. may be mounted in the printer 1 and the control part 76 may control the parts in the printer 1 in accordance with the state of each part in the printer 1 seen from the information from each sensor. In particular, if the ejection characteristics of liquid ejected from the liquid ejection heads 2 (ejection amount, ejection speed, etc.) are influenced by the outside, the driving signal for ejecting the liquid in the liquid ejection heads 2 may be changed as well in accordance with the temperatures of the liquid ejection heads 2, the temperature of the liquid in the liquid tank, and the pressure applied from the liquid in the liquid tank to the liquid ejection heads 2.

(Overall Configuration of Liquid Ejection Head)

Next, a liquid ejection head 2 according to the first embodiment will be explained by using FIG. 2 to FIG. 10.

Figure 5A:
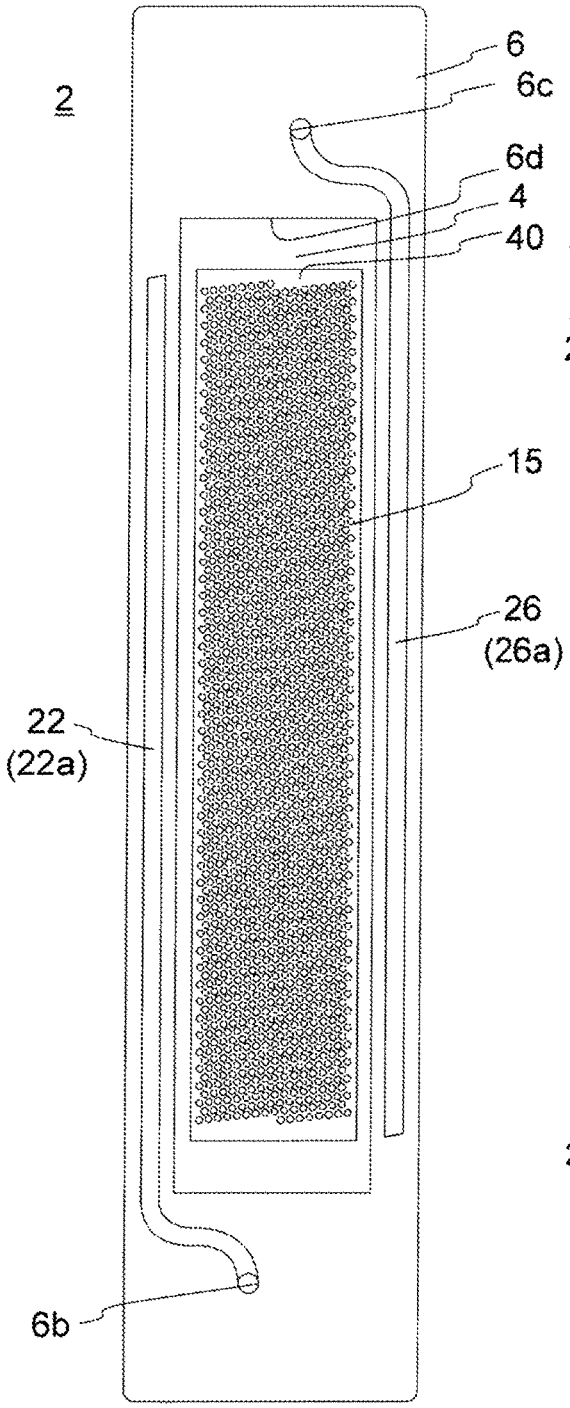
Figure 5B:
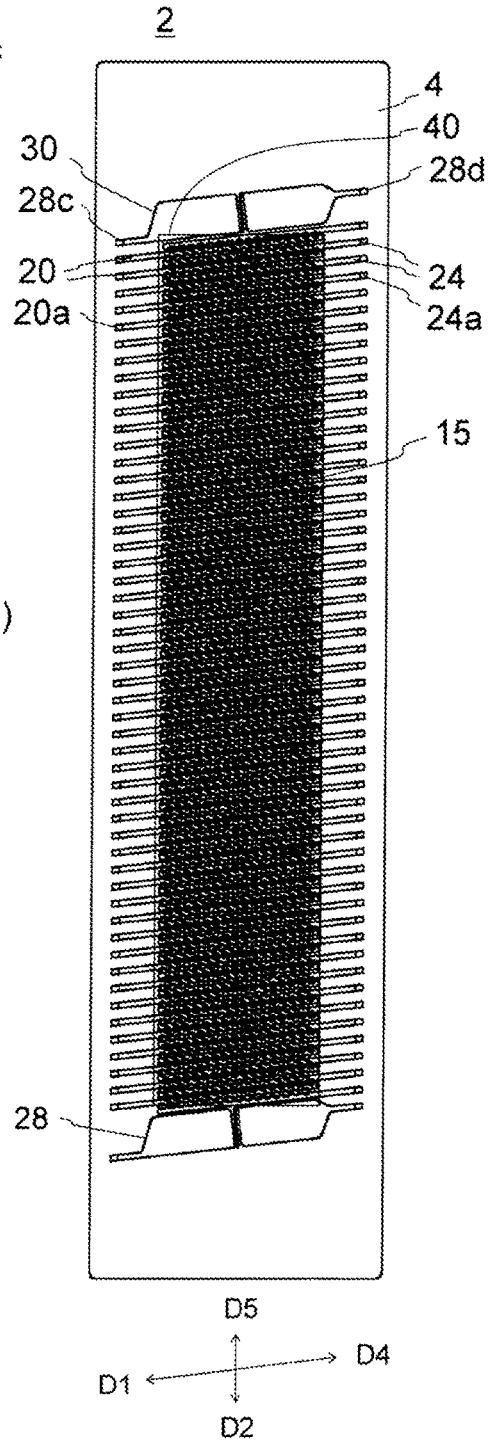
FIG. 5B is a plan view when viewed through the second channel member.

Note that, in FIGS. 5 and 6, in order to facilitate understanding of the drawings, channels etc. which are located below other and so should be drawn by broken lines are drawn by solid lines. Further, FIG. 5A shows a portion of the second channel member 6 as a see-through view, while FIG. 5B shows the entire second channel member 6 as a see-through view. Further, in FIG. 9, the conventional flow of liquid is indicated by a broken line, the flow of the liquid in the ejection unit 15 is indicated by a solid line, and the flow of the liquid supplied from the second individual channel 14 is indicated by a dashed line.

Note that, in the drawings, a first direction D1, second direction D2, third direction D3, fourth direction D4, fifth direction D5, and sixth direction D6 are shown. The first direction D1 is toward one side in the direction in which first common channels 20 and second common channels 24 extend, and the fourth direction D4 is toward the other side in the direction in which the first common channels 20 and second common channels 24 extend. The second direction D2 is toward one side in the direction in which a first integrating channel 22 and second integrating channel 26 extend, and the fifth direction D5 is toward the other side in the direction in which the first integrating channel 22 and second integrating channel 26 extend. The third direction D3 is toward one side in a direction perpendicular to the direction in which the first integrating channel 22 and second integrating channel 26 extend, and the sixth direction D6 is toward the other side in a direction perpendicular to the direction in which the first integrating channel 22 and second integrating channel 26 extend.

In the liquid ejection head 2, the explanation will be given by using the first individual channel 12 as one example of a first channel, the second individual channel 14 as one example of a second channel, and the third individual channel 16 as one example of a third channel.

Figure 2:
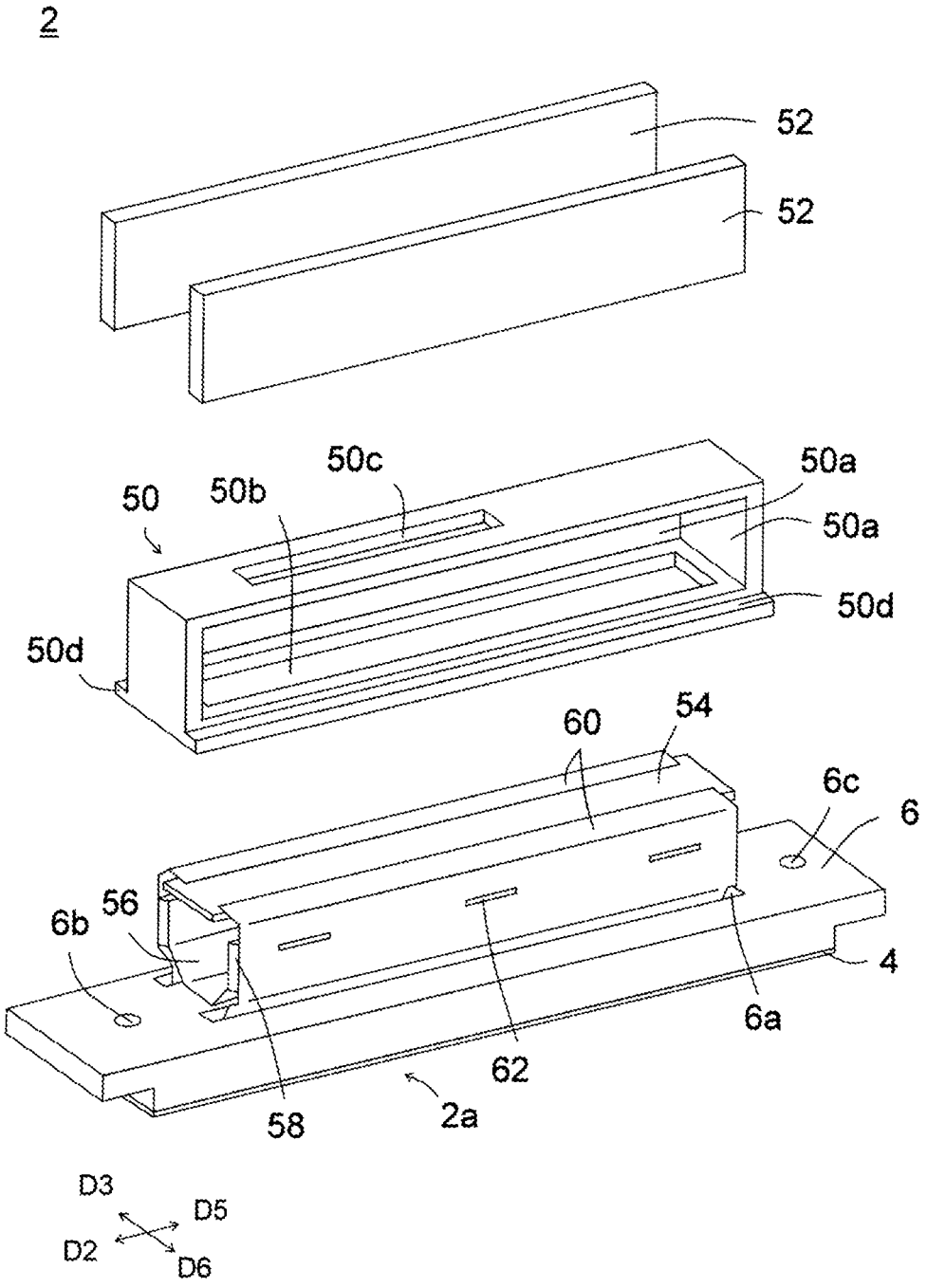
FIG. 2 A disassembled perspective view of the liquid ejection head according to the first embodiment.
Figure 3A:
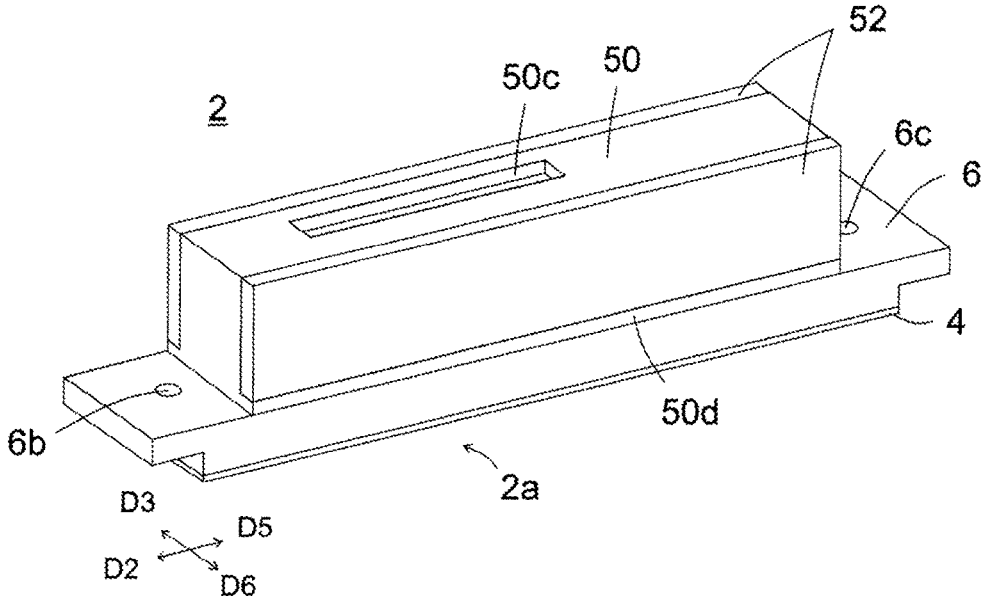
Figure 3B:
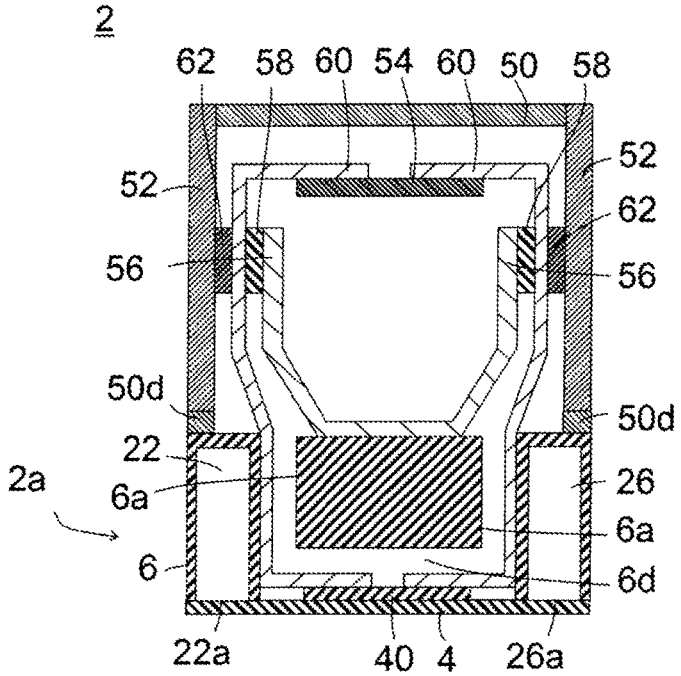
FIG. 3B is a cross-sectional view of the liquid ejection head in FIG. 2.

As shown in FIG. 2, a liquid ejection head 2 is provided with a head body 2*a*, housing 50, heat radiation plates 52, a circuit board 54, pressing member 56, elastic member 58, signal transmission parts 60, and driver ICs (Integrated Circuits) 62. Note that, the liquid ejection head 2 need only be provided with the head body 2*a*. It need not always be provided with the housing 50, heat radiation plates 52, circuit board 54, pressing member 56, elastic member 58, signal transmission parts 60, and driver ICs.

In the liquid ejection head 2, the signal transmission parts 60 are led out from the head body 2*a*. The signal transmission parts 60 electrically connect the head body 2*a* and the circuit board 54. The signal transmission parts 60 are for example flexible circuit boards. The signal transmission parts 60 are provided with the driver ICs 62 for controlling driving of the liquid ejection head 2. The drivers IC 62 are pressed against the heat radiation plates 52 by the pressing member 56 through the elastic member 58. Note that, illustration of support members supporting the circuit board 54 is omitted.

The heat radiation plates 52 can be formed by a metal or alloy and are provided for radiating off heat of the driver ICs 62 to the outside. The heat radiation plates 52 are joined to the housing 50 by screws or an adhesive.

The housing 50 is placed on the head body 2*a*. The members configuring the liquid ejection head 2 are covered by the housing 50 and heat radiation plates 52. The housing 50 is provided with openings 50*a*, 50*b*, and 50*c* and heat insulation parts 50*d*. The openings 50*a* are individually provided so as to face the third direction D3 and the sixth direction D6 and have the heat radiation plates 52 arranged on them. The opening 50*b* is opened toward the bottom. The circuit board 54 and pressing member 56 are arranged inside the housing 50 through the opening 50*b*. The opening 50*c* is opened upward and accommodates inside it a connector (not shown) provided on the circuit board 54.

The heat insulation parts 50*d* are provided so as to extend from the second direction D2 to the fifth direction D5 and are arranged between the heat radiation plates 52 and the head body 2*a*. Due to this, the possibility of transfer of the heat radiated by the heat radiation plates 52 to the head body 2*a* can be reduced. The housing 50 can be formed by a metal, alloy, or plastic.

(Overall Configuration of Head Body)

Figure 4A:
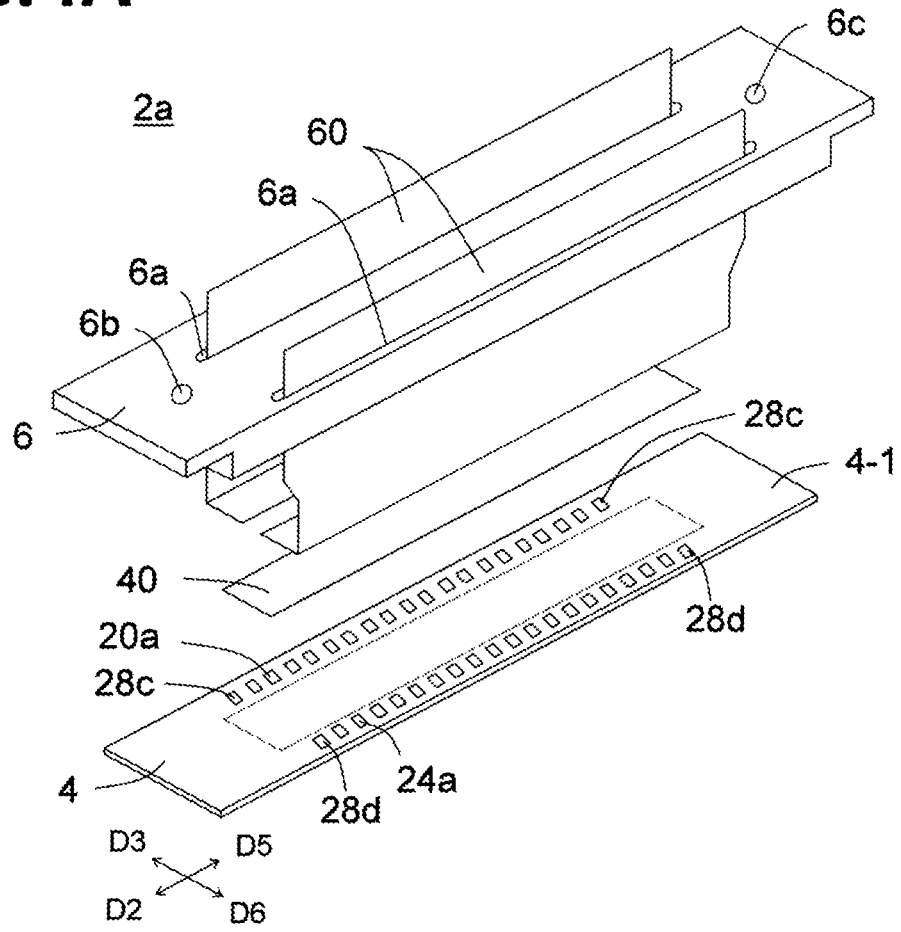

As shown in FIG. 4A, the head body 2*a* is long plate shape extending from the second direction D2 toward the fifth direction D5 and has a first channel member 4, second channel member 6, and piezoelectric actuator substrate 40. In the head body 2*a*, the piezoelectric actuator substrate 40 and second channel member 6 are provided on the first channel member 4. The piezoelectric actuator substrate 40 is placed in a region indicated by the broken line in FIG. 4A. The piezoelectric actuator substrate 40 is provided for pressurizing a plurality of pressurizing chambers 10 (see FIG. 8) provided in the first channel member 4 and has a plurality of displacement elements (see FIG. 8).

(Overall Configuration of Channel Members)

The first channel member 4 has channels formed inside it and guides the liquid supplied from the second channel member 6 up to the ejection holes 8 (see FIG. 8). In the first channel member 4, one major surface forms a pressurizing chamber surface 4-1. Openings 20*a*, 24*a*, 28*c*, and 28*d* are formed in the pressurizing chamber surface 4-1. The openings 20*a* are aligned from the second direction D2 to the fifth direction D5 and are arranged in the end part of the pressurizing chamber surface 4-1 in the third direction D3. The openings 24*a* are aligned from the second direction D2 to the fifth direction D5 and are arranged in the end part of the pressurizing chamber surface 4-1 in the sixth direction D6. The openings 28*c* are provided on the outer side in the second direction D2 and fifth direction D5 from the openings 20*a*. The openings 28*d* are provided on the outer side in the second direction D2 and fifth direction D5 from the openings 24*a*.

The second channel member 6 has channels formed inside it and guides the liquid supplied from the liquid tank to the first channel member 4. The second channel member 6 is provided on the peripheral portion of the pressurizing chamber surface 4-1 of the first channel member 4 and is joined to the first channel member 4 through an adhesive (not shown) outside of the region for placing the piezoelectric actuator substrate 40.

(Second Channel Member (Integrating Channels))

Figure 4B:
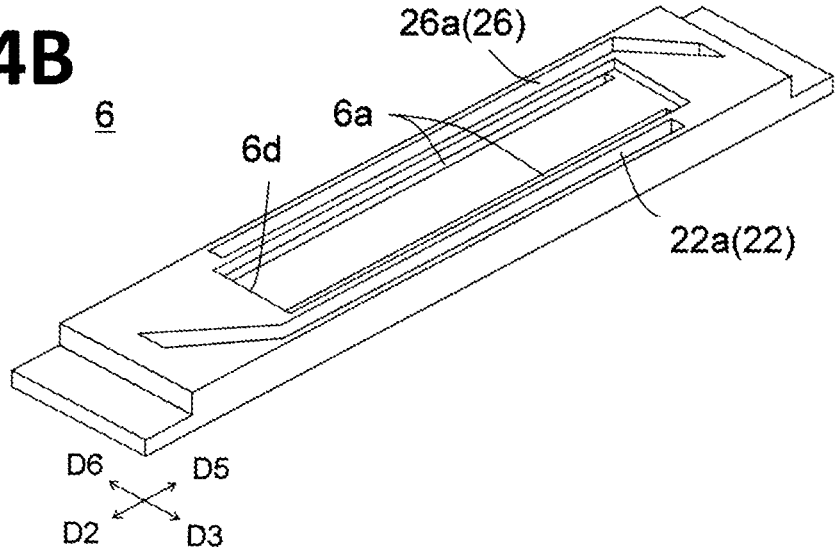
FIG. 4B is a perspective view when viewed from a lower surface of a second channel member.

In the second channel member 6, as shown in FIGS. 4 and 5, through holes 6*a* and openings 6*b*, 6*c*, 6*d*, 22*a*, and 26*a* are formed. The through holes 6*a* are formed so as to extend from the second direction D2 to the fifth direction D5 and are arranged on the outer sides from the region for placing the piezoelectric actuator substrate 40. The signal transmission parts 60 are inserted in the through holes 6*a*.

The opening 6*b* is provided in the upper surface of the second channel member 6 and is arranged in the end part of the second channel member in the second direction D2. The opening 6*b* supplies the liquid from the liquid tank to the second channel member 6. The opening 6*c* is provided in the upper surface of the second channel member 6 and is arranged in the end part of the second channel member in the fifth direction D5. The opening 6*c* recovers the liquid from the second channel member 6 for return to the liquid tank.

The opening 6*d* is provided in the lower surface of the second channel member 6. The piezoelectric actuator substrate 40 is arranged in a space formed by the opening 6*d*.

The opening 22*a* is provided in the lower surface of the second channel member 6 and is provided so as to extend from the second direction D2 toward the fifth direction D5. The opening 22*a* is formed in the end part of the second channel member 6 in the third direction D3 and is provided closer to the third direction D3 side than the through hole 6*a*.

The opening 22*a* is communicated with the opening 6*b*. The first integrating channel 22 is formed by sealing the opening 22*a* by the first channel member 4. The first integrating channel 22 is formed so as to extend from the second direction D2 to the fifth direction D5 and supplies liquid to the openings 20*a* and openings 28*c* in the first channel member 4.

The opening 26*a* is provided in the lower surface of the second channel member 6 and is provided so as to extend from the fifth direction D5 toward the second direction D2. The opening 26*a* is formed in the end part of the second channel member 6 in the sixth direction D6 and is provided closer to the sixth direction D6 side than the through hole 6*a*.

The opening 26*a* is communicated with the opening 6*c*. The second integrating channel 26 is formed by sealing the opening 26*a* by the first channel member 4. The second integrating channel 26 is formed so as to extend from the second direction D2 to the fifth direction D5 and recovers the liquid from the openings 24*a* and openings 28*d* in the first channel member 4.

From the above configuration, in the second channel member 6, the liquid supplied from the liquid tank to the opening 6*b* is supplied to the first integrating channel 22 and flows through the opening 22*a* into the first common channels 20, thereby the liquid is supplied to the first channel member 4. Then, the liquid recovered by the second common channels 24 flows through the opening 26*a* into the second integrating channel 26, then the liquid is recovered at the outside through the opening 6*c*. Note that, the second channel member 6 need not always be provided.

(First Channel Member (Common Channels and Ejection Units))

As shown in FIGS. 5 to 8, the first channel member 4 is formed by stacking a plurality of plates 4*a* to 4*m* and has a pressurizing chamber surface 4-1 and ejection hole surface 4-2. On the pressurizing chamber surface 4-1, the piezoelectric actuator substrate 40 is placed. The liquid is ejected from ejection holes 8 opened in the ejection hole surface 4-2. The plurality of plates 4*a* to 4*m* can be formed by a metal, alloy, or plastic. Note that, rather than stacking the plurality of plates 4*a* to 4*m*, the first channel member 4 may be formed integrally by plastic as well.

In the first channel member 4, a plurality of first common channels 20, plurality of second common channels 24, plurality of end part channels 28, plurality of ejection units 15, and plurality of dummy ejection units 17 are formed. The openings 20*a* and 24*a* are formed in the pressurizing chamber surface 4-1.

The first common channels 20 are provided so as to extend from the first direction D1 to the fourth direction D4 and are formed so as to communicate with the openings 20*a*. Further, the plurality of first common channels 20 are aligned from the second direction D2 toward the fifth direction D5.

The second common channels 24 are provided so as to extend from the fourth direction D4 to the first direction D1 and are formed so as to communicate with the openings 24*a*. Further, the plurality of second common channels 24 are aligned from the second direction D2 toward the fifth direction D5. Each is arranged between each two first common channels 20 adjacent to each other. For this reason, the first common channels 20 and the second common channels 24 are alternately arranged from the second direction D2 toward the fifth direction D5.

In the first channel member 4, damper chambers 32 (FIG. 8B) are provided so as to face the second common channels 24. That is, the damper chambers 32 are arranged so as to face the second common channels 24 through dampers 30. The dampers 30 include a first damper 30*a* and second damper 30*b*. The damper chambers 32 include a first damper chamber 32*a* and second damper chamber 32*b*. The first damper chamber 32*a* is provided over the second common channels 24 through the first damper 30*a*. The second damper chamber 32*b* is provided under the second common channels 24 through the second damper 30*b*. By providing dampers 30 in this way, pressure waves entering into the second common channels 24 can be attenuated.

The end part channel 28 is formed in the end part of the first channel member 4 in the second direction D2 and end part in the fifth direction D5. The end part channel 28 has broad-width portions 28*a*, a narrowed portion 28*b*, and openings 28*c* and 28*d*. The liquid supplied from the opening 28*c* flows through the broad-width portion 28*a*, narrowed portion 28*b*, broad width portion 28*a*, and opening 28*d* in that order to thereby flow through the end part channel 28. Due to that, the liquid becomes present in the end part channel 28 while the liquid flows through the end part channel 28, therefore the temperature of the end part channel 28 is made uniform by the liquid. Therefore, in the first channel member 4, the possibility of heat radiation from the end part in the second direction D2 and the end part in the fifth direction D5 is reduced. Further, by arranging the end part channel 28 in the end part in the second direction D2, the flow rate near the opening 24*a* positioned on the end part in the second direction D2 becomes faster in the second integrating channel 26, therefore precipitation of pigment etc. contained in the liquid can be suppressed. In the same way, by arranging the end part channel 28 in the end part in the fifth direction D5, the flow rate near the opening 20*a* positioned on the end part in the second direction D2 becomes faster in the first integrating channel 22, therefore precipitation of pigment etc. contained in the liquid can be suppressed.

(Shape of Ejection Unit)

Figure 7A:
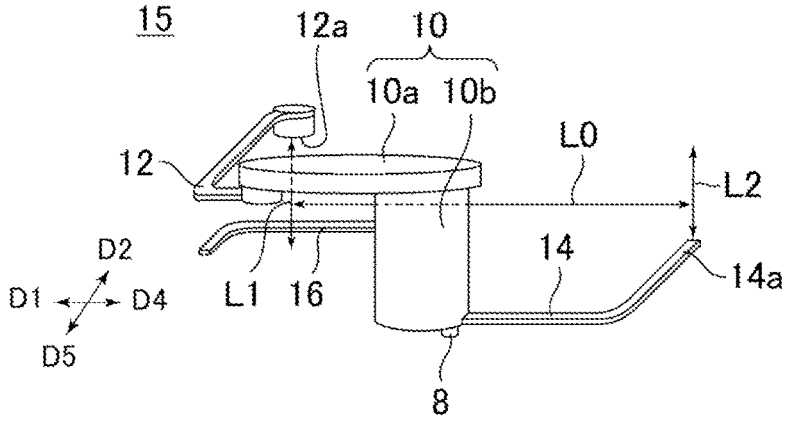
Figure 7B:
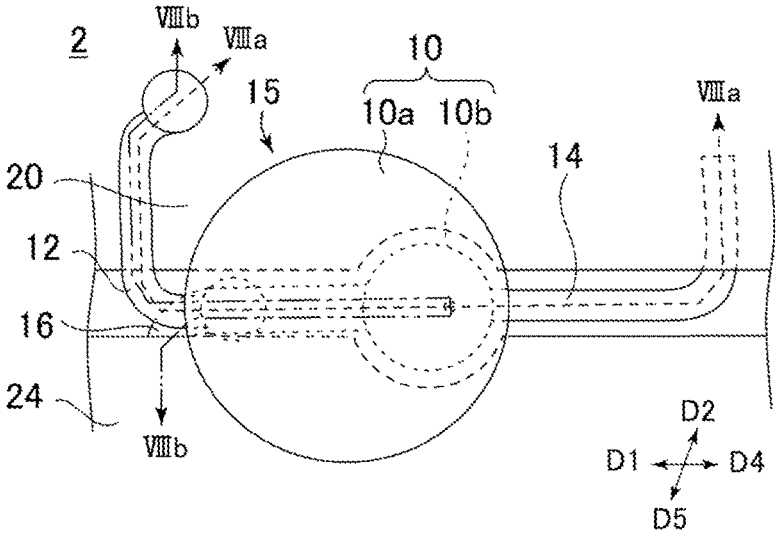
FIG. 7B is a plan view of the ejection unit.

Each ejection unit 15, as shown in FIG. 7A, has an ejection hole 8, pressurizing chamber 10, first individual channel 12, second individual channel 14, and third individual channel 16. The ejection units 15 are provided between first common channels 20 and second common channels 24 which are adjacent to each other and form a matrix in a surface direction of the first channel member 4. The ejection units 15 form ejection unit columns 15*a* and ejection unit rows 15*b*. The ejection unit columns 15*a* are aligned from the first direction D1 toward the fourth direction D4. The ejection unit rows 15*b* are aligned from the second direction D2 toward the fifth direction D5.

Further, the pressurizing chambers 10 form pressurizing chamber columns 10*c* and pressurizing chamber rows 10*d*. Ejection hole columns 8*a* and pressurizing chamber columns 10*c* are aligned from the first direction D1 toward the fourth direction D4 in the same way. Further, ejection hole rows 8*b* and pressurizing chamber rows 10*d* are aligned from the second direction D2 toward the fifth direction D5 in the same way. Note that, each ejection hole row 8*b* is configured by ejection holes 8 which are connected with the pressurizing chambers 10 belonging to two pressurizing chamber rows 10*d*.

The angle formed by the first direction D1 and the fourth direction D4 and the second direction D2 and fifth direction D5 is off from a right angle. For this reason, the ejection holes 8 belonging to the ejection hole columns 8*a* which are arranged along the first direction D1 are arranged offset in the second direction D2 by the amount of the angle off from the right angle. Further, the ejection hole columns 8*a* are arranged aligned in the second direction D2, therefore the ejection holes 8 belonging to the different ejection hole columns 8*a* are arranged offset in the second direction D2 by that amount. By combining them, the ejection holes 8 in the first channel member 4 are aligned at constant intervals in the second direction D2. Due to this, printing can be carried out so as to fill a predetermined range with pixels formed by the ejected liquid.

Figure 6:
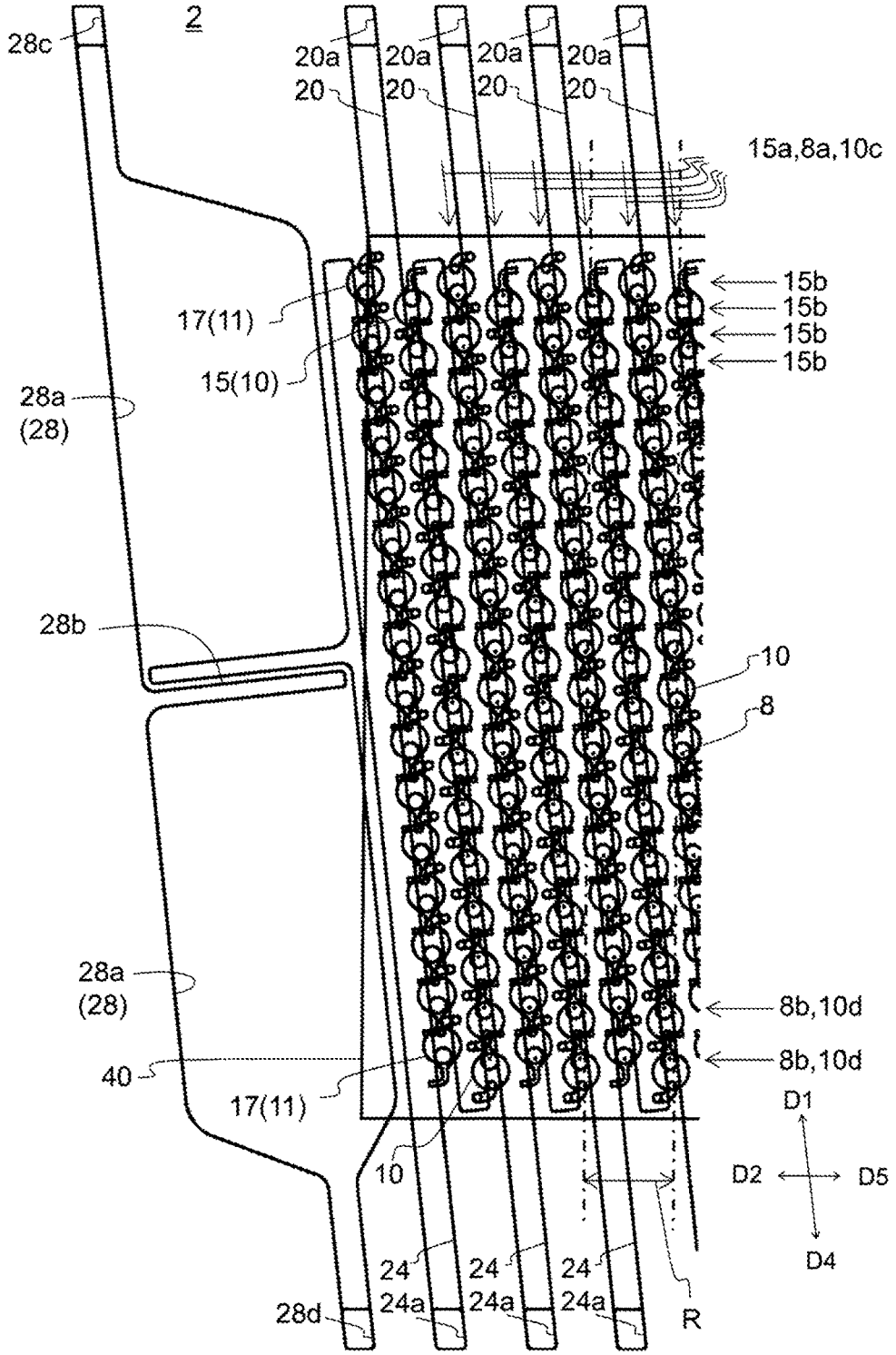
FIG. 6 A plan view showing a portion in FIGS. 5A and 5B enlarged.

In FIG. 6, when projecting the ejection holes 8 to the third direction D3 and sixth direction D6, 32 ejection holes 8 are projected in a range of the imaginary lines R, therefore the ejection holes 8 are aligned at intervals of 360 dpi on the imaginary lines R. Due to this, if the recording medium P is conveyed in the direction perpendicular to the imaginary lines R to perform printing, printing can be carried out with a resolution of 360 dpi.

The dummy ejection units 17 (dummy pressurizing chambers 11) are provided between the first common channel 20 positioned nearest the second direction D2 side and the second common channel 24 positioned nearest the second direction D2 side. Further, the dummy ejection units 17 are also provided between the first common channel 20 positioned nearest the fifth direction D5 side and the second common channel 24 positioned nearest the fifth direction D5 side. The dummy ejection units 17 are provided so as to stabilize the ejection of the ejection unit column 15*a* which is positioned nearest the second direction D2 or fifth direction D5 side.

Each ejection unit 15, as shown in FIG. 7A, has an ejection hole 8, pressurizing chamber 10, first individual channel 12, second individual channel 14, and third individual channel 16. In the liquid ejection head 2, the liquid is supplied from the first individual channel 12 and second individual channel 14 to the pressurizing chamber 10. The third individual channel 16 recovers the liquid from the pressurizing chamber 10.

The pressurizing chamber 10 has a pressurizing chamber body 10*a* and partial channel 10*b*. The pressurizing chamber body 10*a* is circular shaped when viewed on a plane. The partial channel 10*b* extends from the center of the pressurizing chamber body 10*a* toward the bottom. The pressurizing chamber body 10*a* is configured so as to apply pressure to the liquid in the partial channel 10*b* by receiving pressure from the displacement element 48 provided on the pressurizing chamber body 10*a*.

The pressurizing chamber body 10*a* is a right circular cylinder shape and has a circular planar shape. By the planar shape being circular, the amount of displacement and the change of volume of the pressurizing chamber 10 caused by displacement can be made larger. The partial channel 10*b* is a right circular cylinder shape having a smaller diameter than the pressurizing chamber body 10*a* and has a circular planar shape. Further, the partial channel 10*b* is arranged at a position where it falls in the pressurizing chamber body 10*a* when viewed from the pressurizing chamber surface 4-1.

Note that, the partial channel 10*b* may be a cone shape or conical frustum shape where the cross-sectional area becomes smaller toward the ejection hole 8 side as well. Due to that, the widths of the first common channel 20 and second common channel 24 can be made larger, therefore the supply and discharge of the liquid can be stabilized.

The pressurizing chambers 10 are aligned along the two sides of each of the first common channels 20 and configure one column on each side, i.e., two pressurizing chamber columns 10*c* in total. The first common channels 20 and the pressurizing chambers 10 which are aligned on the two sides thereof are connected through the first individual channels 12 and second individual channels 14.

Further, the pressurizing chambers 10 are aligned along the two sides of each of the second common channels 24 and configure one column on each side, i.e., two pressurizing chamber columns 10*c* in total. The second common channels 24 and the pressurizing chambers 10 which are aligned on the two sides thereof are connected through the third individual channels 16.

A first individual channel 12 connects a first common channel 20 and a pressurizing chamber body 10*a*. The first individual channel 12 extends upward from the upper surface of the first common channel 20, then extends toward the fifth direction D5, extends toward the fourth direction D4, and then extends upward again and is connected to the bottom surface of the pressurizing chamber body 10*a*.

A second individual channel 14 connects a first common channel 20 and a partial channel 10*b*. The second individual channel 14 extends from the lower surface of the first common channel 20 toward the fifth direction D5, extends toward the first direction D1, and then is connected to the side surface of the partial channel 10*b*.

A third individual channel 16 connects a second common channel 24 and a partial channel 10*b*. The third individual channel 16 extends from the side surface of the second common channel 24 toward the second direction D2, extends toward the fourth direction D4, and then is connected to the side surface of the partial channel 10*b*. The channel resistance of the third individual channel 16 is made smaller than the channel resistance of the second individual channel 14.

According to the configuration described above, in the first channel member 4, the liquid supplied through the openings 20*a* to the first common channels 20 flows into the pressurizing chambers 10 through the first individual channels 12 and second individual channels 14. Part of the liquid is ejected from the ejection holes 8. Further, the remaining liquid flows from the pressurizing chambers 10 into the second common channels 24 through the third individual channels 16 and is discharged from the first channel member 4 to the second channel member 6 through the openings 24*a*.

(Piezoelectric Actuator)

The piezoelectric actuator substrate 40 including the displacement elements 48 is joined to the top surface of the first channel member 4. It is arranged so that the displacement elements 48 are positioned over the pressurizing chambers 10. The piezoelectric actuator substrate 40 occupies a region having substantially the same shape as that of the pressurizing chamber group formed by the pressurizing chambers 10. Further, the openings of the pressurizing chambers 10 are closed by the piezoelectric actuator substrate 40 being joined to the pressurizing chamber surface 4-1 of the first channel member 4.

The piezoelectric actuator substrate 40 has a multilayer structure configured by two piezoelectric ceramic layers 40*a* and 40*b* which are piezoelectric bodies. Each of these piezoelectric ceramic layers 40*a* and 40*b* has a thickness of about 20 μm. Both of the piezoelectric ceramic layers 40*a* and 40*b* extend across the plurality of pressurizing chambers 10.

These piezoelectric ceramic layers 40*a* and 40*b* are made of for example a lead zirconate titanate (PZT)-based, $NaNbO_3$-based, $BaTiO_3$-based, $(BiNa)NbO_3$-based, $BiNaNb_5O_{15}$-based, or other ceramic material having ferroelectricity. Note that, the piezoelectric ceramic layer 40*b* acts as a vibration plate and does not always have to be a piezoelectric substance. Another ceramic layer or metal plate which is not a piezoelectric substance may be used in place of it.

On the piezoelectric actuator substrate 40, a common electrode 42, individual electrodes 44, and connection electrodes 46 are formed. The common electrode 42 is formed over almost the entire surface of the surface direction in a region between the piezoelectric ceramic layer 40*a* and the piezoelectric ceramic layer 40*b*. Further, the individual electrodes 44 are arranged at the positions facing the pressurizing chambers 10 on the upper surface of the piezoelectric actuator substrate 40.

The parts of the piezoelectric ceramic layer 40*a* which are sandwiched between the individual electrodes 44 and the common electrode 42 form unimorph structure displacement elements 48 which are polarized in the thickness direction and displace when voltage is applied to the individual electrodes 44. For this reason, the piezoelectric actuator substrate 40 has a plurality of displacement elements 48.

The common electrode 42 can be formed by an Ag—Pd-based metal material or the like. The thickness of the common electrode 42 can be made about 2 μm. The common electrode 42 has a common electrode-use surface electrode (not shown) on the piezoelectric ceramic layer 40*a*. The common electrode-use surface electrode is connected with the common electrode 42 through a via hole formed penetrating through the piezoelectric ceramic layer 40*a*, is grounded, and is held at a ground potential.

Figure 7C:
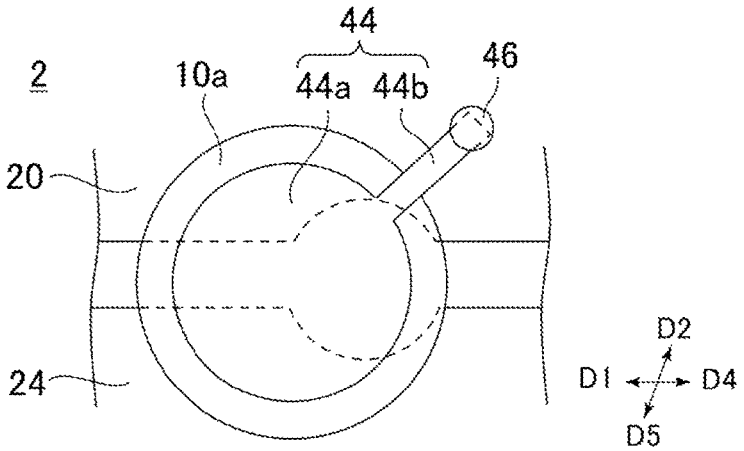
FIG. 7C is a plan view showing an electrode on the ejection unit.

An individual electrode 44 is formed by an Au-based metal material or other material and has an individual electrode body 44*a* and led out electrode 44*b*. As shown in FIG. 7C, the individual electrode body 44*a* is formed in an almost circular shape when viewed on a plane and is formed smaller than the pressurizing chamber body 10*a*. The led out electrode 44*b* is led out from the individual electrode body 44*a*. A connection electrode 46 is formed on the led out led out electrode 44*b*.

The connection electrode 46 is made of for example silver-palladium containing glass frit and is formed so as to project out with a thickness of about 15 μm. The connection electrode 46 is electrically joined with an electrode provided in the signal transmission part 60.

(Ejection Operation)

Next, the ejection operation of the liquid will be explained. Under control from the control part 76, the displacement elements 48 displace by driving signals supplied to the individual electrodes 44 through the driver ICs 62 etc. As the driving method, use can be made of so-called pull-push driving.

An ejection unit 15 in the liquid ejection head 2 will be explained in detail by using FIGS. 9 and 10. Note that, in FIG. 9, the actual flow of liquid is indicated by the solid lines, the conventional flow of liquid is indicated by the broken line, and the flow of the liquid supplied from the second individual channel 14 is indicated by the dashed line.

The ejection unit 15 is provided with an ejection hole 8, pressurizing chamber 10, first individual channel 12, second individual channel 14, and third individual channel 16. The first individual channel 12 and the second individual channel 14 are connected to the first common channel 20 (see FIG. 8), while the third individual channel 16 is connected to the second common channel 24. For this reason, the ejection unit 15 is supplied with the liquid from the first individual channel 12 and second individual channel 14. The liquid which is not ejected is recovered by the third individual channel 16.

The first individual channel 12 is connected on the first direction D1 side of the pressurizing chamber body 10*a*. The second individual channel 14 is connected on the fourth direction D4 side of the partial channel 10*b*. The third individual channel 16 is connected on the first direction D1 side of the partial channel 10*b*.

The liquid supplied from the first individual channel 12 passes through the pressurizing chamber body 10*a* and flows downward in the partial channel 10*b*. Part of this is ejected from the ejection hole 8. The liquid which is not ejected from the ejection hole 8 is recovered at the outside of the ejection unit 15 through the third individual channel 16.

Part of the liquid supplied from the second individual channel 14 is ejected from the ejection hole 8. The liquid which is not ejected from the ejection hole 8 flows upward in the partial channel 10*b* and is recovered at the outside of the ejection unit 15 through the third individual channel 16.

Figure 9:
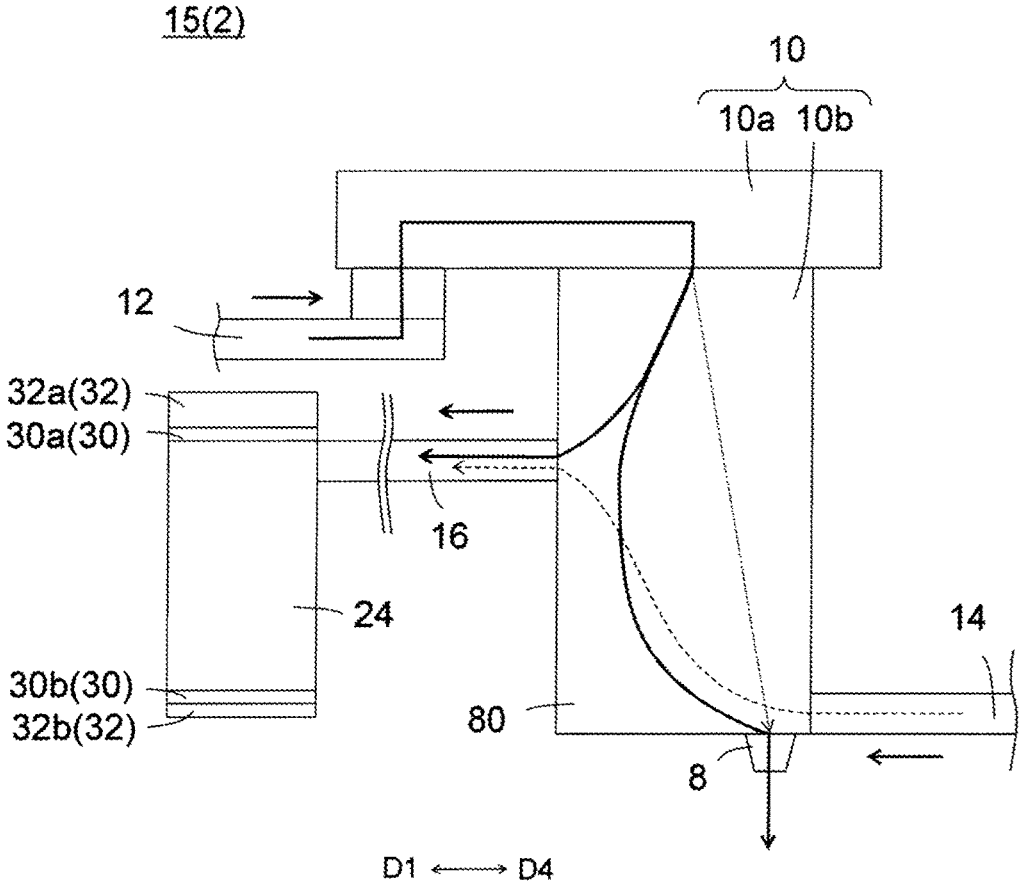
FIG. 9 A conceptual view showing a flow of a fluid inside the liquid ejection unit.

Here, as shown in FIG. 9, the liquid supplied from the first individual channel 12 flows through the pressurizing chamber body 10*a* and partial channel 10*b* and is ejected from the ejection hole 8. As indicated by the broken line, the flow of the liquid in the conventional ejection unit uniformly flows in a substantially linear state from the central part of the pressurizing chamber body 10*a* toward the ejection hole 8.

When such a flow is generated, in the partial channel 10*b*, an area 80 and its periphery positioned on the opposite side from the outlet of the second individual channel 14 are configured to be hard for the liquid to flow through. Therefore, for example, there is a possibility of generation of a region in which the liquid pools near the area 80.

Contrary to this, in the first channel member 4, the first individual channel 12 and second individual channel 14 for supplying liquid are connected to the positions of the pressurizing chamber 10 which are different from each other. Specifically, for example, the first individual channel 12 is connected to the pressurizing chamber body 10*a*, while the second individual channel 14 is connected to the partial channel 10*b*.

For this reason, the flow of the liquid supplied from the second individual channel 14 to the partial channel 10*b* can be made to strike the flow of the liquid which is supplied from the pressurizing chamber body 10*a* to the ejection hole 8. Due to that, the liquid which is supplied from the pressurizing chamber body 10*a* to the ejection hole 8 can be kept from uniformly and substantially linearly flowing, therefore the possibility of generation of a region where the liquid pools in the partial channel 10*b* can be reduced.

That is, the position of the point where the liquid pools, which is generated by the flow of the liquid supplied from the pressurizing chamber body 10*a* to the ejection hole 8, moves due to collision of the flow of the liquid supplied from the pressurizing chamber body 10*a* to the ejection hole 8, therefore the possibility of generation of a region where the liquid pools in the partial channel 10*b* can be reduced.

Further, the third individual channel 16 for recovery of liquid is connected to the pressurizing chamber 10. Specifically, for example, the third individual channel 16 is connected to the partial channel 10*b*. For this reason, the flow of the liquid from the second individual channel 14 toward the third individual channel 16 transverses the internal portion of the partial channel 10*b*. As a result, the liquid which flows from the second individual channel 14 toward the third individual channel 16 can be made to flow so as to transverse the flow of the liquid supplied from the pressurizing chamber body 10*a* to the ejection hole 8. Therefore, the possibility of generation of a region where the liquid pools in the partial channel 10*b* can be further reduced.

Note that, the third individual channel 16 may be connected to the pressurizing chamber body 10*a* as well. In this case as well, the flow of the liquid supplied from the second individual channel 14 can be made to strike the flow of the liquid supplied from the pressurizing chamber body 10*a* to the ejection hole 8.

(Details of Individual Channels Etc.)

Further, the third individual channel 16 is connected to the partial channel 10*b* and is connected closer to the pressurizing chamber body 10*a* side than the second individual channel 14. For this reason, even in a case where air bubbles intrude to the internal portion of the partial channel 10*b* from the ejection hole 8, air bubbles can be discharged to the third individual channel 16 by utilizing the buoyancy of the air bubbles. Due to that, the possibility of air bubbles remaining in the partial channel 10*b* and thereby exerting an influence upon the propagation of pressure to the liquid can be reduced.

Further, the second individual channel 14 is connected to the ejection hole 8 side of the partial channel 10*b*. Due to that, the flow rate of the liquid in the vicinity of the ejection hole 8 can be made faster, therefore the possibility of precipitation of pigment etc. contained in the liquid and clogging in the ejection hole 8 can be reduced.

Further, when viewed on a plane, the first individual channel 12 is connected on the first direction D1 side of the pressurizing chamber body 10*a*, while the second individual channel 14 is connected on the fourth direction D4 side of the partial channel 10*b*.

For this reason, when viewed on a plane, the liquid ends up being supplied to the ejection unit 15 from two sides of the first direction D1 and fourth direction D4. For this reason, the supplied liquid has a velocity component of the first direction D1 and velocity component of the fourth direction D4. Therefore, the liquid supplied to the pressurizing chamber 10 will agitate the liquid inside the partial channel 10*b*. As a result, the possibility of generation of a region where the liquid pools in the partial channel 10*b* can be further reduced.

Further, the third individual channel 16 is connected on the first direction D1 side of the partial channel 10*b*, while the ejection hole 8 is arranged on the fourth direction D4 side of the partial channel 10*b*. Due to that, the liquid can be made flow also to the first direction D1 side of the partial channel 10*b*, therefore the possibility of generation of a region where the liquid pools inside the partial channel 10*b* can be reduced.

Note that, the head may be configured so that the third individual channel 16 is connected on the fourth direction D4 side of the partial channel 10*b*, while the ejection hole 8 is arranged on the first direction D1 side of the partial channel 10*b* as well. In that case as well, the same effects can be exerted.

Further, as shown in FIG. 8, the third individual channel 16 is connected on the pressurizing chamber body 10*a* side of the second common channel 24. Due to that, the air bubbles discharged from the partial channel 10*b* can be made to flow along the upper surface of the second common channel 24. Due to that, the air bubbles can be easily discharged to the outside from the second common channel 24 through the opening 24*a* (see FIG. 6).

Further, preferably the top surface of the third individual channel 16 and the top surface of the second common channel 24 are flush. Due to that, the air bubbles discharged from the partial channel 10*b* will flow along the top surface of the third individual channel 16 and the top surface of the second common channel 24, therefore can be discharged to the outside more easily.

Further, when viewed on a plane, the first individual channel 12 is connected to the first direction D1 side of the pressurizing chamber body 10*a*, while the center of gravity of the area of the partial channel 10*b* is positioned closer to the fourth direction D4 side than the center of gravity of the area of the pressurizing chamber body 10*a*. That is, the partial channel 10*b* is connected in the pressurizing chamber body 10*a* on the side far away from the first individual channel 12.

Due to that, the liquid supplied to the first direction D1 side of the pressurizing chamber body 10*a* expands over the entire area of the pressurizing chamber body 10*a* and then is supplied to the partial channel 10*b*. As a result, the possibility of generation of a region where the liquid pools inside the pressurizing chamber body 10*a* can be reduced.

Further, when viewed on a plane, the ejection hole 8 is arranged between the second individual channel 14 and the third individual channel 16. Due to that, at the time of ejection of liquid from the ejection hole 8, the position at which the flow of the liquid supplied from the pressurizing chamber body 10*a* to the ejection hole 8 and the flow of the liquid supplied from the second individual channel 14 strike each other can be moved.

That is, the amount of ejection of liquid from the ejection hole 8 will differ according to the image printed. Along with increase or decrease of the amount of ejection of liquid, the behavior of the liquid inside the partial channel 10*b* changes. For this reason, according to the increase or decrease of the amount of ejection of liquid, the position at which the flow of the liquid supplied from the pressurizing chamber body 10*a* to the ejection hole 8 and the flow of the liquid supplied from the second individual channel 14 strike each other moves, therefore the possibility of formation of a region where the liquid pools inside the partial channel 10*b* can be reduced.

Further, the center of gravity of area of the ejection hole 8 is positioned closer to the fourth direction D4 side than the center of gravity of area of the partial channel 10*b*. Due to that, the liquid supplied to the partial channel 10*b* expands over the entire area of the partial channel 10*b* and is then supplied to the ejection hole 8, therefore the possibility of generation of a region where the liquid pools inside the partial channel 10*b* can be reduced.

Here, when the pressurizing chamber 10 is pressurized, the liquid ejection head 2 ejects the liquid from the ejection hole 8 by the pressure wave being transferred from the pressurizing chamber body 10*a* to the ejection hole 8. For this reason, there is a possibility of propagation of pressure to the first common channel 20 by part of the pressure wave generated in the pressurizing chamber body 10*a* being transferred to the second individual channel 14. In the same way, there is a possibility of propagation of pressure to the second common channel 24 by part of the pressure wave generated in the pressurizing chamber body 10*a* being transferred to the third individual channel 16.

Further, if pressure is propagated to the first common channel 20 and second common channel 24, there is a possibility of propagation of pressure to a pressurizing chamber 10 in another ejection unit 15 through the second individual channel 14 and third individual channel 16 connected to the other ejection unit 15. Due to that, there is a possibility of fluid crosstalk.

Contrary to this, the liquid ejection head 2 is configured so that the channel resistance of the third individual channel 16 is lower than the channel resistance of the second individual channel 14. Therefore, when a pressure is applied to the pressurizing chamber 10, part of the pressure wave generated in the pressurizing chamber body 10*a* becomes easier to be propagated to the second common channel 24 through the third individual channel 16 having a lower channel resistance than the second individual channel 1, therefore a configuration resistant to propagation of pressure to the first common channel 20 is obtained.

Further, the first damper chamber 32*a* is arranged above the second common channels 24, and the second damper chamber 32*b* is arranged below the beneath of the second common channels 24, therefore the first damper 30*a* is formed above the second common channels 24, and the second damper 30*b* is formed below the second common channels 24.

Due to that, pressure can be attenuated inside the second common channel 24. As a result, backflow of pressure from the second common channel 24 to the third individual channel 16 can be suppressed, therefore the possibility of crosstalk can be reduced.

Further, the third individual channel 16 is connected to the side surface of the second common channel 24 in the second direction D2. In other words, the third individual channel 16 is led out from the side surface of the second common channel 24 in the second direction D2 to the second direction D2 and then is led out to the forth direction D4, and is connected to the side surface of the partial channel 10*b* in the first direction D1.

Therefore, the third individual channel 16 can be led out to the surface direction, therefore space for providing the damper chambers 32 above and below the second common channels 24 can be secured. As a result, the pressure can be efficiently attenuated in the second common channels 24.

Figure 10:
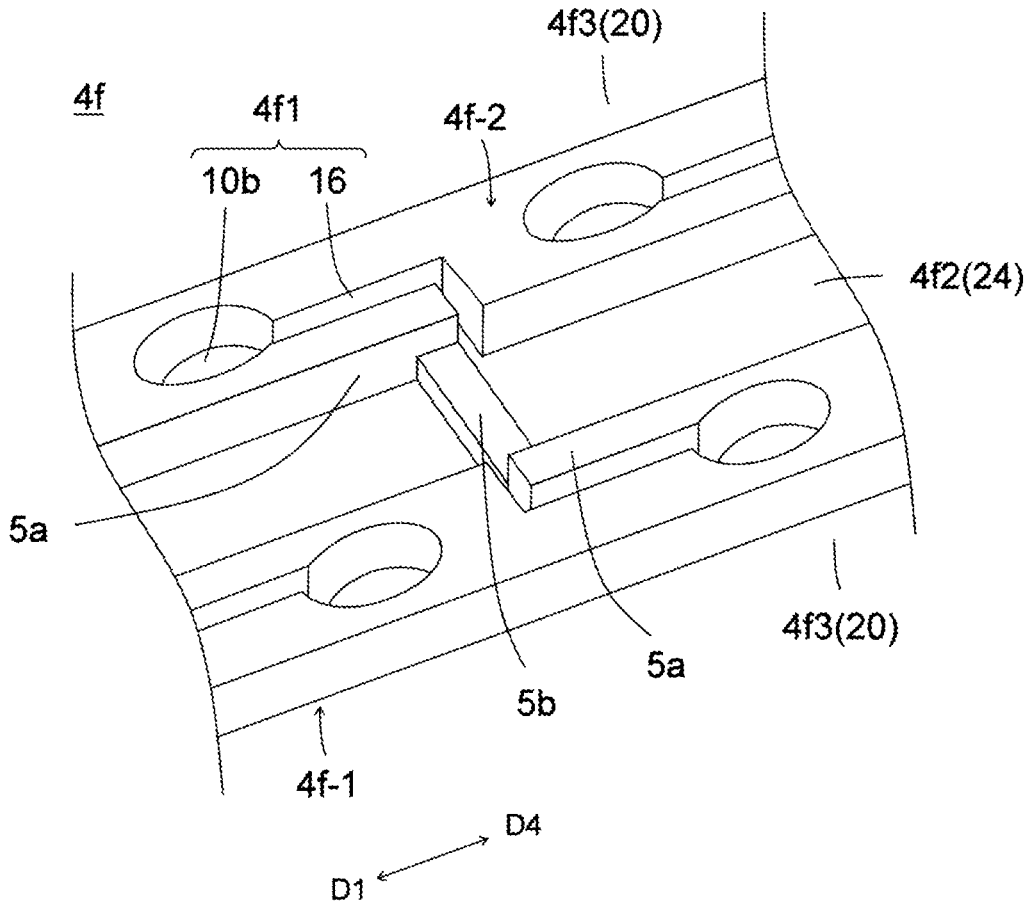
FIG. 10 A perspective view showing a portion of a plate forming the first channel member enlarged.

The third individual channel 16, as shown in FIG. 10, is formed by a plate 4*f*. The plate 4*f* has a first surface 4*f*-1 on the pressurizing chamber surface 4-1 side and a second surface 4*f*-2 on the ejection hole surface 4-2 side. Further, the plate 4*f* has a first groove 4*f*1 forming the third individual channel 16, a second groove 4*f*2 forming the second common channel 24, and a third groove 4*f*3 forming the first common channel 20. Further, between the first groove 4*f*1 and the second groove 4*f*2, partition walls 5*a* are provided. The partition walls 5*a* are provided for each ejection unit 15 in order to partition the first groove 4*f*1 and the second groove 4*f*2. The plate 4*f* has a connection part 5*b* for connecting the partition walls 5*a* facing while sandwiching the second common channel 24 between them to each other.

The first groove 4*f*1 penetrates through the plate 4*f* and forms the partial channel 10*b* and the third individual channel 16. For this reason, the first grooves 4*f*1 are formed in a matrix in the plate 4*f*. The second groove 4*f*2 penetrates through the plate 4*f* and forms the second common channel 24.

The plate 4*f* has the connection part 5*b* which connects the partition walls 5*a* which face each other while sandwiching the second common channel 24 between them. For this reason, the rigidity of the partition walls 5*a* can be raised, therefore the possibility of deformation caused in the partition wall 5*a* can be reduced. As a result, the shape of the first groove 4*f*1 can be stabilized, and the possibility of variation in shapes of the third individual channels 16 in the ejection units 15 can be reduced. Therefore, variation of ejection in the ejection units 15 can be reduced.

Further, preferably the thickness of the connection part 5*b* is smaller than the thickness of the plate 4*f*. Due to that, a reduction of volume of the second common channel 24 can be suppressed. As a result, an increase of channel resistance of the second common channel 24 can be suppressed. Note that, the connection part 5*b* can be formed by performing half etching from the second surface 4*f*-2 (may be first surface 4*f*-1 as well).

Further, the third individual channel 16 is connected to the upper end part side of the second common channel 24, and the capacity of the first damper chamber 32*a* is larger than the capacity of the second damper chamber 32*b*. For this reason, the pressure wave propagated from the third individual channel 16 can be attenuated in the first damper 30*a*.

(Configuration for Reduction of Pressure Wave)

As described above, in the present embodiment, the first individual channel 12 and second individual channel 14 in each ejection unit 15, that is, the two individual channels for supplying the liquid which are connected to the same pressurizing chamber 10, are connected to the same first common channel 20. Accordingly, the pressure wave generated in the pressurizing chamber 10 is liable to return back to the pressurizing chamber 10 after passing through the first individual channel 12, first common channel 20, and second individual channel 14 in this order or through these channels in an inverse order. Therefore, the present embodiment employs the following configuration.

(Separation Distance of Individual Channels in Each Ejection Unit)

Figure 12:
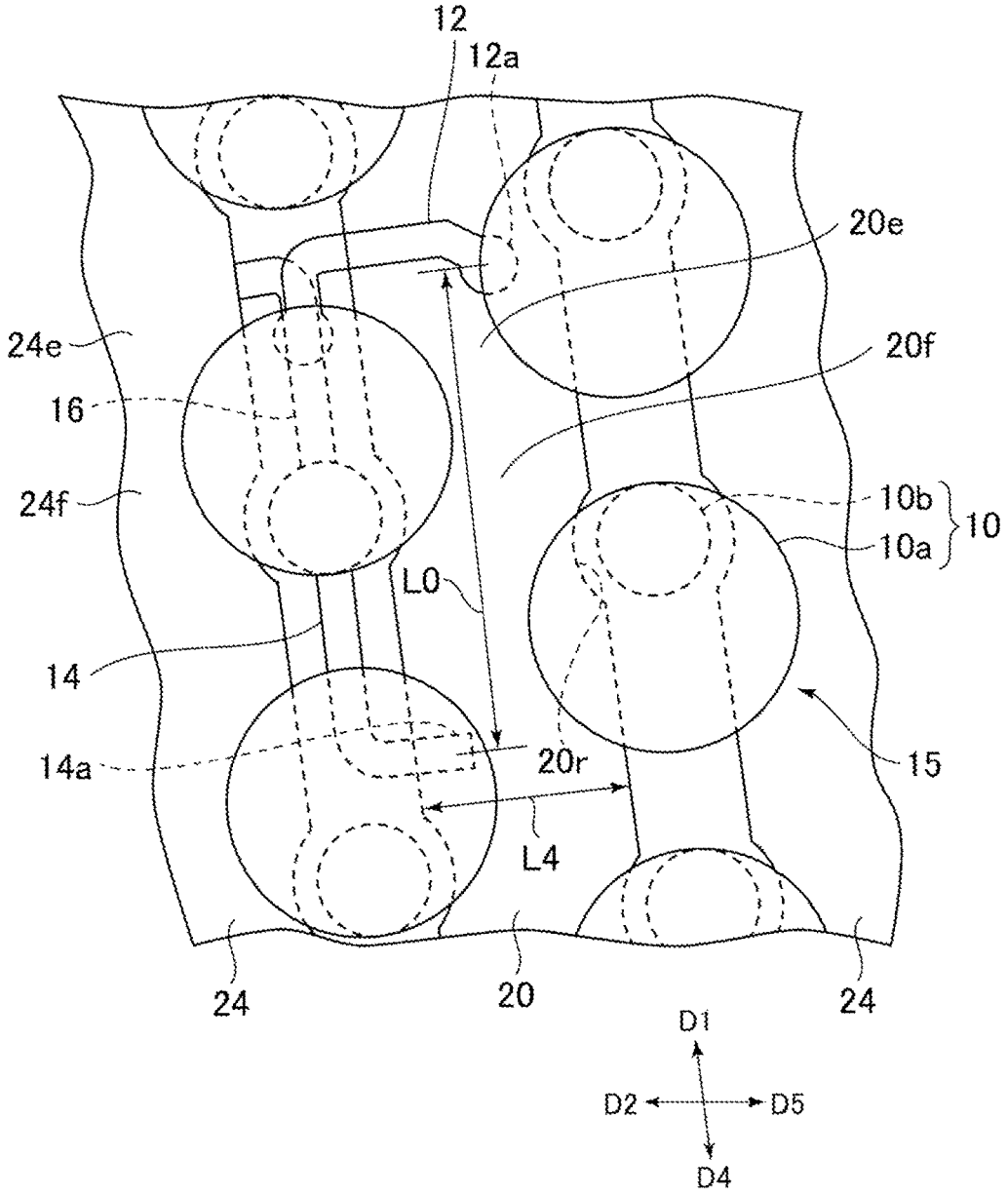
FIG. 12 A plan view showing positional relationships between first to third individual channels and first and second common channels for one ejection unit.

A distance in the channel direction of the first common channel 20 between the opening 12*a* on the first common channel 20 side in the first individual channel 12 and the opening 14*a* on the first common channel 20 side in the second individual channel 14 is defined as L0 (see FIG. 7A and FIG. 12). Note that, the distance L0 may use for example the center of the opening 12*a* and the center of the opening 14*a* as the standard.

Figure 8A:
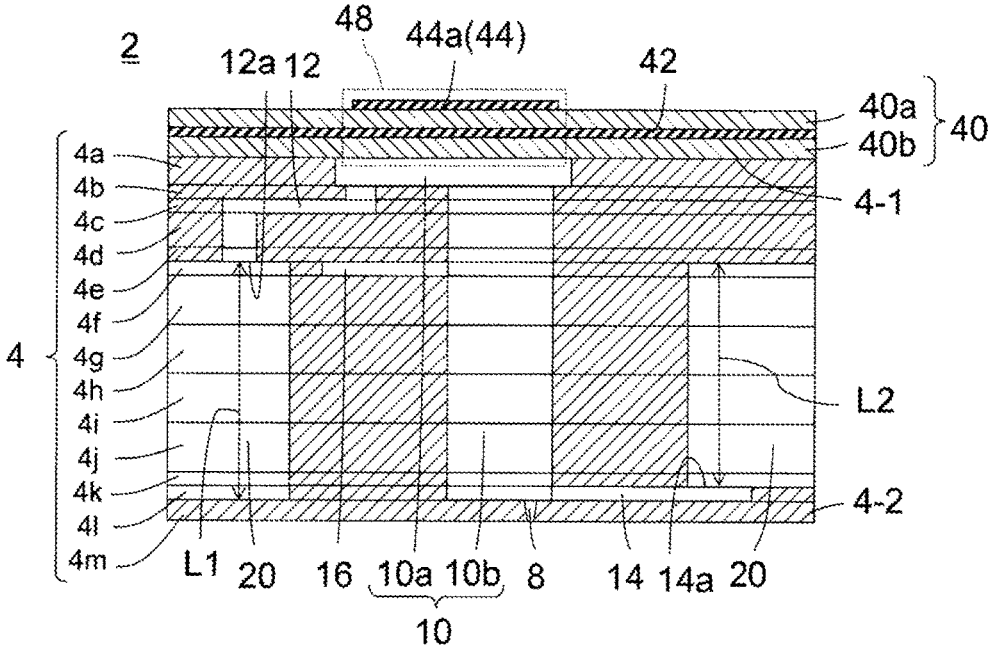
Figure 8B:
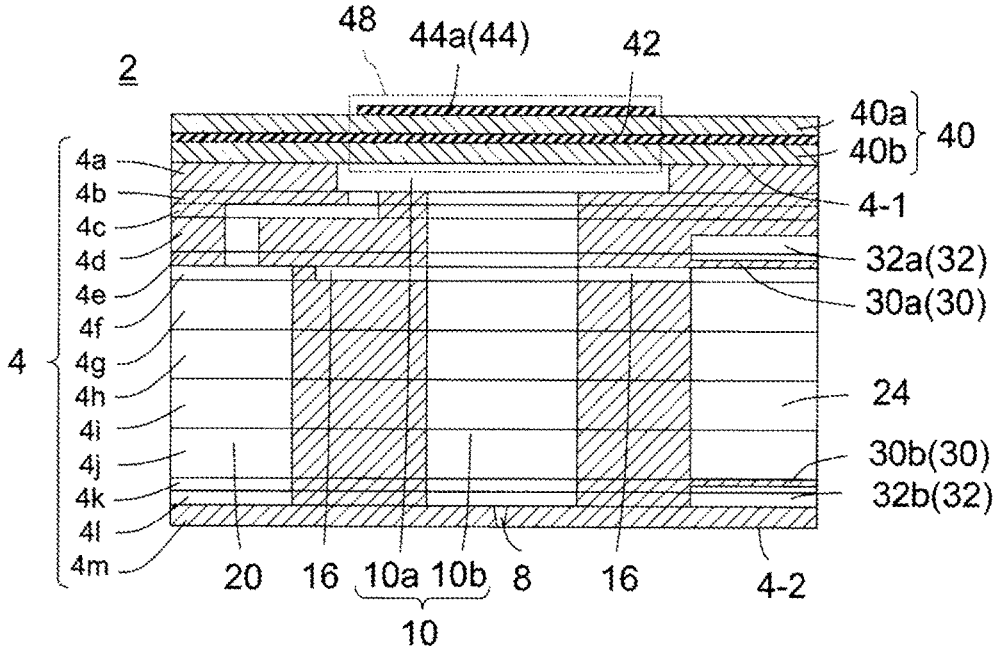
FIG. 8B is a cross-sectional view along the VIIIb-VIIIb line in FIG. 7B.

Further, the width (diameter) of the first common channel 20 at the position of the opening 12*a* is defined as L1 (see FIG. 7A and FIG. 8A). The width (diameter) of the first common channel 20 at the position of the opening 14*a* is defined as L2 (see FIG. 7A and FIG. 8A). The width of the first common channel 20 at the position of the opening is, in more detail, the distance between the opening and the inner surface of the first common channel 20 to which the opening faces. Accordingly, the width referred to here is not limited to the length in the right-left direction.

At this time, as shown in FIG. 7A, for example, L0 is L1 or more, and/or L0 is L2 or more.

The pressure wave generated in the pressurizing chamber 10 three-dimensionally expands from the opening 12*a* to the interior of the first common channel 20 and then advances to two directions along the first common channel 20. That is, the pressure wave first attenuates due to the three-dimensional expansion. After completely expanding over the entire width direction of the first common channel 20, the pressure wave only expands almost one-dimensionally, therefore the attenuation is weakened. That is, by arranging the opening 14*a* at a position spaced apart from the opening 12*a* where attenuation occurs relatively suddenly by a distance not less than the width of the first common channel 20, the pressure wave entering into the opening 14*a* becomes one attenuated, therefore the pressure wave returning back to the pressurizing chamber 10 becomes weaker. The pressure wave expanding from the opening 142*a* to the first common channel 20 was explained. However, the same is true also for the pressure wave expanding from the opening 14*a* to the first common channel 20.

(Shape of Common Channels)

Figure 11:
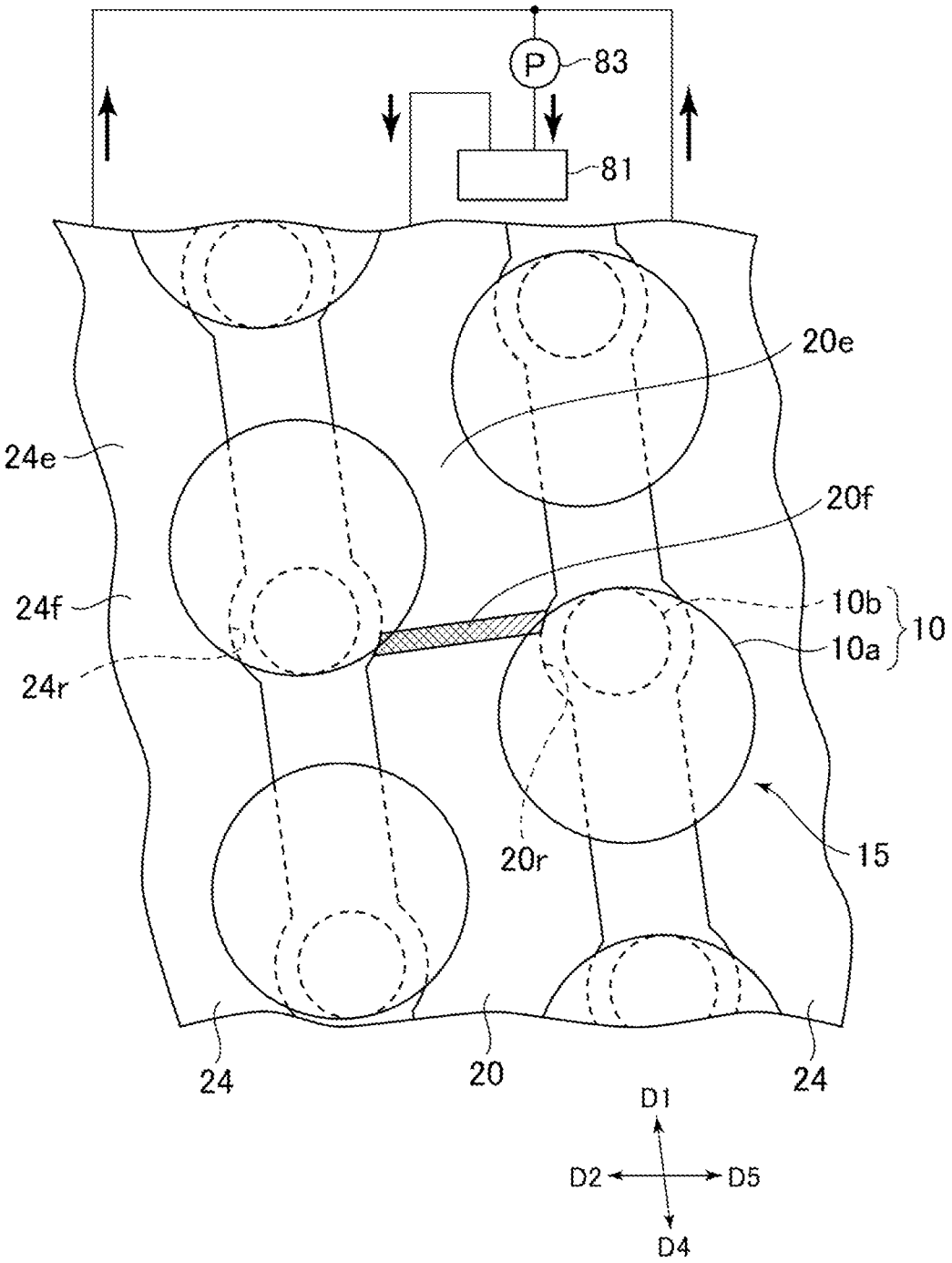
FIG. 11 A plan view showing a portion of channels in the first channel member.

FIG. 11 is a plan view showing a portion of the channels in the first channel member 4. Note that, in FIG. 11, the tank 81 for storing the liquid circulating through the first common channels 20, the ejection units 15, and the second common channels 24; and the pump 83 generating the pressure required for circulation are schematically shown as well.

As already explained, the first common channels 20 and the second common channels 24 extend parallel to each other. The plurality of ejection units 15 (only the pressurizing chambers 10 are shown in FIG. 11) are substantially aligned between the first common channels 20 and the second common channels 24 along these common channels.

Further, in a first common channel 20, at the positions where the partial channels 10*b* of the pressurizing chambers 10 are arranged in the channel direction, first recessed portions 20*r* formed by recesses at the outsides of the channel at the side surfaces when viewed on a plane are formed. In turn, the cross-sectional area (area of the cross-section (lateral cross-section) in the direction perpendicular to the channel direction) is reduced. That is, a first common channel 20, in the channel direction, has a plurality of first portions 20*e* and a plurality of second portions 20*f* each of which is positioned between two among the plurality of first portions 20*e* and has a smaller cross-sectional area than the first portions 20*e* in front and back of it.

In the same way, in a second common channel 24, at the positions where the partial channels 10*b* of the pressurizing chambers 10 are arranged in the channel direction, second recessed portions 24*r* formed by recesses at the outsides of the channel at the side surfaces when viewed on a plane are formed. In turn, the cross-sectional area is reduced. That is, the second common channel 24, in the channel direction, has a plurality of third portions 24*e* and a plurality of fourth portions 24*f* each of which is positioned between two among the plurality of third portions 24*e* and has a smaller cross-sectional area than the third portions 24*e* in front and back of it.

Note that, the ranges of the first portions 20*e* and second portions 20*f* in the channel direction (from another viewpoint, the boundaries of them) may be suitably defined. For example, as indicated by hatching in FIG. 11, the sections having the smallest cross-sectional area among the sections reduced in cross-sectional area may be defined as the second portions 20*f* while the other sections or the sections which are not reduced in cross-sectional area among the other sections may be defined as the first portions 20*e*. In any definition, it remains unchanged that each second portion 20*f* has smaller area than the first portions 20*e* in front and back of it. This is true also for the third portions 24*e* and fourth portions 24*f*.

Turning to the partial channels 10*b*, for example, parts are positioned in the first recessed portions 20*r* and the second recessed portions 24*f*. The distance between a first portion 20*e* and a third portion 24*e* (the shortest distance) is for example smaller than the diameter of a partial channel 10*b* and pressurizing chamber body 10*a*. Note, this distance, unlike the present embodiment, may be equal to the diameter of a partial channel 10*b* or larger as well. The shapes of the first recessed portion 20*r* and second recessed portion 24*r* may be suitably set. However, for example they are arcs of circles concentric with the partial channel 10*b* or arcs of ellipses close to such circles.

(Connection Positions of Individual Channels in Each Ejection Unit)

FIG. 12 is a plan view showing the positional relationships among the first individual channel 12, second individual channel 14, and third individual channel 16 and the first common channel 20 and second common channel 24 for only the ejection unit 15 at the center on the left side in the drawing. Note that, as will be understood from FIG. 13 to FIG. 15 which will be explained later, the individual channels in the other ejection units 15 are the same as the ones shown in the shapes, sizes and the positions relative to portions of the common channels. Note, in the relationship between the adjacent ejection unit columns 15*a*, the orientations of the individual channels are rotated by 180° from each other.

In each ejection unit 15, the first individual channel 12 and the second individual channel 14 are connected to two positions of the first common channel 20 which sandwich at least one second portion 20*f* between them.

Accordingly, for example, if the pressure wave generated in the pressurizing chamber 10 is propagated through the first individual channel 12 to the first common channel 20, the pressure wave is reflected at the second portion 20*f* having a cross-sectional area relatively reduced. That is, it is harder for the pressure wave to be propagated to the position of connection of the second individual channel 14 compared with a case where the first recessed portion 20*r* is not provided. As a result, return of the pressure wave to the pressurizing chamber 10 is suppressed. The route from the first individual channel 12 to the second individual channel 14 was explained. However, the same is true also for a route reverse to the former. Further, by suppression of return of a pressure wave to the pressurizing chamber 10, for example, the precision of ejection of droplets is improved and consequently the quality of image is improved.

In each ejection unit 15, the first individual channel 12 is connected to the first portion 20*e*. From another viewpoint, the plurality of first individual channels 12 which are individually connected to the ejection units 15 belonging to one ejection unit column 15*a* are individually connected to the plurality of first portions 20*e*.

Accordingly, for example, even if a pressure wave is propagated from the first individual channel 12 to the first common channel 20 (first portion 20*e*), it becomes easier to shut a pressure wave in the first portion 20*e* by the two second portions 20*f* sandwiching that first portion 20*e*. That is, the propagation in the first common channel 20 of the pressure wave from each first individual channel 12 is easily restricted with respect to the entire length of the first common channel 20. As a result, for example, in the first common channel 20, not only is the propagation of a pressure wave from the first individual channel 12 to the second individual channel 14 in each ejection unit 15 (connected to the same pressurizing chamber 10) suppressed, but also the propagation of a pressure wave from the first individual channel 12 to the first individual channel 12 or second individual channel 14 in the other ejection units 15 is suppressed. Further, for example, the concern of superimposition of pressure waves from the first individual channels 12 in the plurality of ejection units 15 in the first common channel 20 to specifically cause a large pressure fluctuation in a portion of the first common channel 20 is reduced.

In each ejection unit 15, the second individual channel 14 is connected to the first portion 20*e*. From another viewpoint, the plurality of second individual channels 14 which are individually connected to the ejection units 15 belonging to one ejection unit column 15*a* are individually connected to the plurality of first portions 20*e*.

Accordingly, for example, in the same way as the connection of the first individual channel 12 to the first portion 20*e* described above, it becomes easier to shut in a pressure wave propagated from the second individual channel 14 to the first common channel 20 (first portion 20*e*), therefore various effects are exerted. Further, by the plurality of individual channels being individually connected to the first portions 20*e* with respect to both of the first individual channels 12 and second individual channels 14, the effect of reduction of unintended pressure fluctuation is synergistically improved. For example, when the channel length differs between the plurality of first individual channels 12 and the plurality of second individual channels 14, there is a concern over beating due to overlapping of the pressure waves from the two in the first common channel 20, but such a concern is reduced.

In each ejection unit 15, the third individual channel 16 is connected to the third portion 24*e*. From another viewpoint, a plurality of third individual channels 16 which are individually connected to the ejection units 15 belonging to one ejection unit column 15*a* are individually connected to the plurality of third portions 24*e*.

Accordingly, for example, in the same way as the above first individual channel 12 being connected to the first portion 20*e*, it becomes easier to shut in a pressure wave propagated from the third individual channel 16 to the second common channel 24 (third portion 24*e*). As a result, for example, the concern of propagation of the pressure wave among the plurality of third individual channels 16 through the second common channel 24 is reduced. Further, in a case where all of the three individual channels are connected to the first portions 20*e* or third portions 24*e*, the propagation of the pressure wave from the other ejection units 15 to the pressurizing chamber 10 is reduced most, so this is preferred.

In each ejection unit 15, the first individual channel 12 and the second individual channel 14 are individually connected to the two first portions 20*e* in the first common channel 20 which are adjacent to each other while sandwiching one second portion 20*f* between them. Further, in each ejection unit 15, the first individual channel 12 is connected to the position on the side opposite from the first portion 20*e* with which the second individual channel 14 is connected relative to the center position of the first portion 20*e* with which this first individual channel 12 is connected.

Accordingly, for example, it is possible to assign the first individual channel 12 and second individual channel 14 of one ejection unit 15 to the front and back of one second portion 20*f* to simplify the positional relationships between the second portion 20*f* and the ejection unit 15. Along with such simplification, by separating the connection position of the first individual channel 12 with respect to the first common channel 20 from the second portion 20*f* (from another viewpoint, the second individual channel 14) as much as possible, the loop comprised of the pressurizing chamber 10, first individual channel 12, first common channel 20, and second individual channel 14 becomes longer. As a result, for example, the pressure wave generated in the pressurizing chamber 10 becomes easier to attenuate before it returns to the pressurizing chamber 10. That is, both a simple configuration of the first individual channel 12 and second individual channel 14 and suppression of unintended pressure fluctuation in the pressurizing chamber 10 can be achieved.

In each ejection unit 15, the second individual channel 14 is connected to a position on the side opposite from the first portion 20*e* with which the first individual channel 12 is connected relative to the center position of the first portion 20*e* with which this second individual channel 14 is connected.

By separating not only the first individual channel 12, but also the second individual channel 14 from the second portion 20*f* as much as possible in this way, the effect of achieving both a simple configuration and suppression of unintended pressure fluctuation explained above can be obtained to the maximum limit.

(Positional Relationships of Individual Channels Among Ejection Units)

Figure 13:
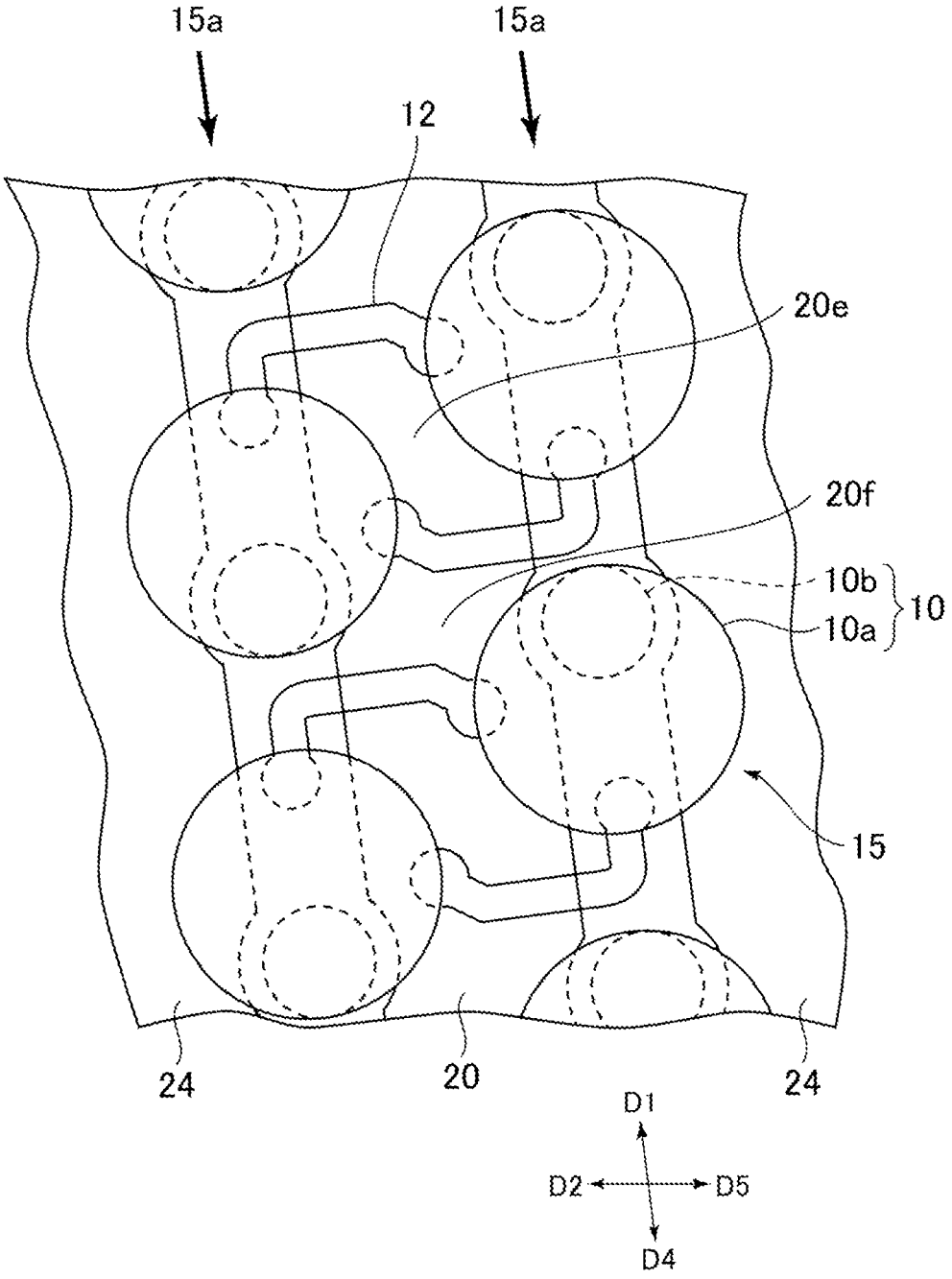
FIG. 13 A plan view showing the positional relationships between the plurality of first individual channels and the first common channel.

FIG. 13 is a plan view showing the positional relationships between a plurality of first individual channels 12 and a first common channel 20.

In each ejection unit column 15*a*, the first individual channels 12 in the adjacent ejection units 15 are individually connected to two positions in the first common channel 20 which sandwich at least one second portion 20*f* (one in the present embodiment) between them.

Accordingly, in each ejection unit column 15*a*, the concern of the pressure wave propagated from the first individual channel 12 of one ejection unit 15 between adjacent ejection units 15 to the first common channel 20 entering into the first individual channel 12 of the other ejection unit 15 between adjacent ejection units 15 is reduced. That is, fluid crosstalk is suppressed.

To one first portion 20*e*, two first individual channels 12 of the ejection unit columns 15*a* adjacent to each other are connected. These two first individual channels 12 are connected to the two sides with respect to the center position in the channel direction of the first portion 20*e* and are connected to the two sides with respect to the center position of the width direction of the same. Due to this, the connection positions of the two are separated as much as possible, so fluid crosstalk is suppressed.

Figure 14:
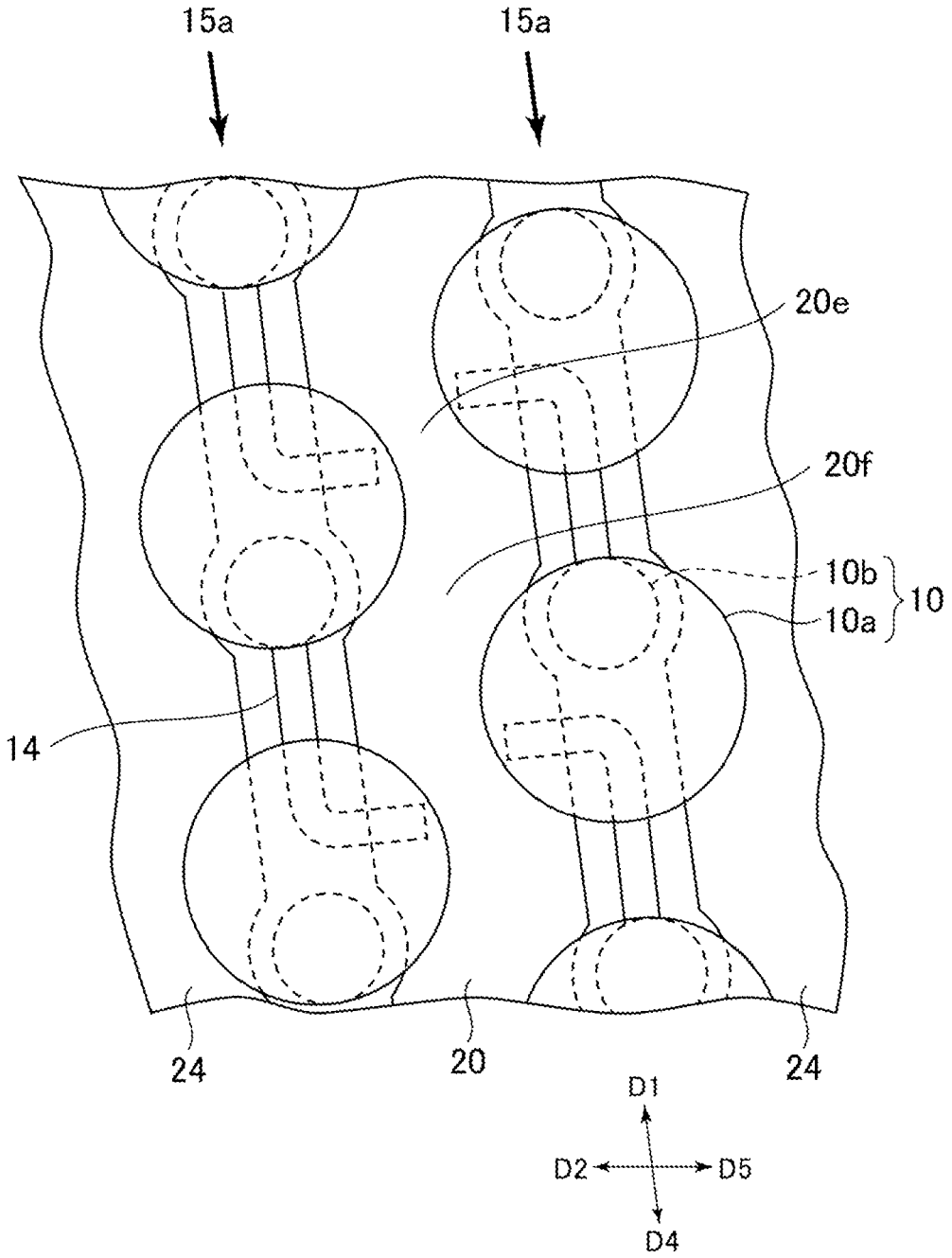
FIG. 14 A plan view showing the positional relationships between the plurality of second individual channels and the first common channel.

FIG. 14 is a plan view showing the positional relationships between a plurality of second individual channels 14 and a first common channel 20.

In the ejection unit columns 15*a*, the second individual channels 14 in the ejection units 15 adjacent to each other are individually connected to two positions in the first common channel 20 which sandwich at least one second portion 20*f* (one in the present embodiment) between them.

Accordingly, in the same way as the first individual channels 12, in each ejection unit column 15*a*, the concern over the pressure wave propagated from the second individual channel 14 in one ejection unit 15 between the ejection units 15 adjacent to each other to the first common channel 20 entering into the second individual channel 14 in the other ejection unit 15 between the ejection units 15 adjacent to each other is reduced. That is, fluid crosstalk is suppressed.

To one first portion 20*e*, two second individual channels 14 in the ejection unit columns 14*a* adjacent to each other are connected. These two second individual channels 14 are connected to the two sides with respect to the center position of the channel direction of the first portion 20*e* and are connected to the two sides with respect to the center position of the width direction of the same. Due to this, the connection positions of the two are separated as much as possible, so fluid crosstalk is suppressed.

Figure 15:
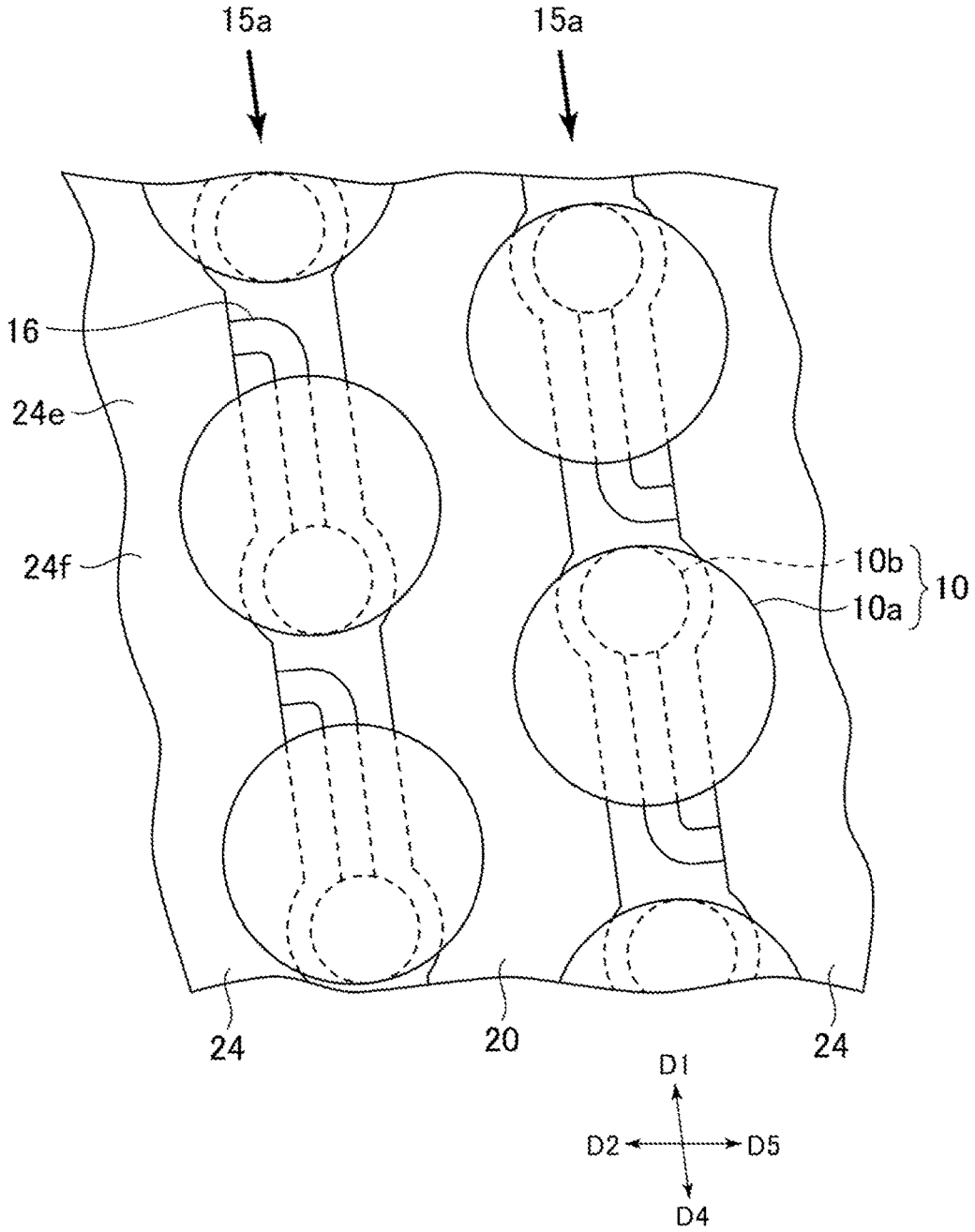
FIG. 15 A plan view showing the positional relationships between the plurality of third individual channels and the second common channel.

FIG. 15 is a plan view showing the positional relationships between a plurality of third individual channels 16 and a second common channel 24.

In each ejection unit column 15*a*, the third individual channels 16 in the ejection units 15 adjacent to each other are connected to two positions in a second common channel 24 which sandwich at least one fourth portion 24*f* (one in the present embodiment) between them.

Accordingly, in the same way as the first individual channels 12, in each ejection unit column 15*a*, the concern over a pressure wave which is propagated from the third individual channel 16 in one ejection unit 15 between the ejection units 15 adjacent to each other to the second common channel 24 entering into the third individual channel 16 in the other ejection unit 15 between the ejection units 15 adjacent to each other is reduced. That is, fluid crosstalk is suppressed.

Second Embodiment

Figure 16A:
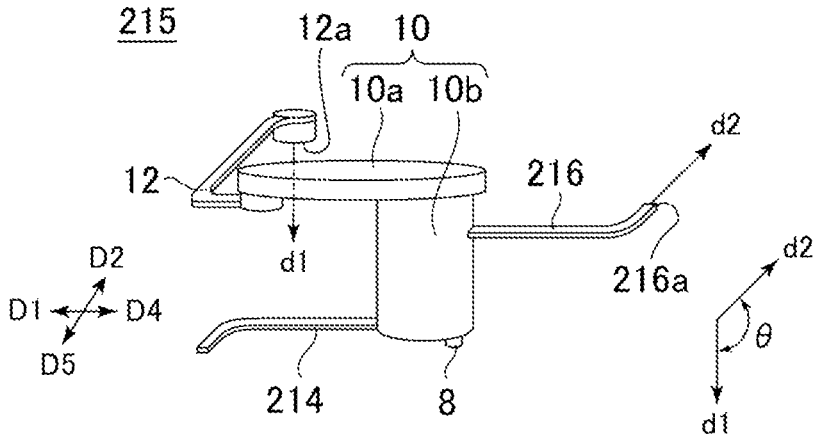

FIG. 16A is a perspective view showing an ejection unit 215 according to a second embodiment and corresponds to FIG. 7A for the first embodiment.

Note that, in the explanation of the second and following embodiments, regarding configurations which are the same as or resemble the configurations in the first embodiment, sometimes use will be made of notations attached to configurations in the first embodiment, and explanations will be sometimes omitted.

The configuration of the second embodiment is different from the configuration of the first embodiment only in the second individual channel and third individual channel. The rest of the configuration is the same as the first embodiment from the overall configuration of the printer up to the other parts of the ejection units.

The connection position of the second individual channel 214 with respect to the pressurizing chamber 10 is the same as the second individual channel 14 in the first embodiment except the connection position being on the first direction D1 side (first individual channel 12 side) with respect to the partial channel 10*b*. That is, the second individual channel 214 is connected to the lower end of the side surface of the partial channel 10*b*.

Further, as will be understood from the fact that the second individual channel 214 extends to the first direction D1 and then extends to the fifth direction D5 (reverse to the direction in which the first individual channel 12 extends toward the first common channel 20), the second individual channel 214 is connected to the second common channel 24 unlike the second individual channel 14 in the first embodiment. That is, the second individual channel 214 functions as a channel for recovering liquid from the pressurizing chamber 10.

Although not particularly shown, when viewed on a plane, the connection position of the second individual channel 214 with respect to the second common channel 24 is for example the same as the connection position of the third individual channel 16 with respect to the second common channel 24 in the first embodiment. That is, the second individual channel 214 is connected to the third portion 24*e*. Further, when viewed on a side surface (viewed on a cross-section), the connection position of the second individual channel 214 with respect to the second common channel 24 is for example the same as the connection position of the second individual channel 14 with respect to the first common channel 20 in the first embodiment.

The connection position of the third individual channel 216 with respect to the pressurizing chamber 10 is the same as the third individual channel 16 in the first embodiment except the connection position being on the fourth direction D4 side (opposite side from the first individual channel 12) with respect to the partial channel 10*b*. That is, the third individual channel 216 is connected to the side closer to the pressurizing chamber body 10*a* side than the second individual channel 214 in the side surface of the partial channel 10*b*.

Further, as will be understood from the fact that the third individual channel 216 extends to the fourth direction D4 and then extends to the second direction D2 (the direction in which the first individual channel 12 extends to the first common channel 20), the third individual channel 216 is connected to the first common channel 20 unlike the third individual channel 16 in the first embodiment. That is, the third individual channel 216 functions as a channel for supplying liquid to the pressurizing chamber 10.

Although not particularly shown, when viewed on a plane, the connection position of the third individual channel 216 with respect to the first common channel 20 is for example the same as the connection position of the second individual channel 14 with respect to the first common channel 20 in the first embodiment. That is, the third individual channel 216 is connected to the first portion 20*e* so as to sandwich the second portion 20*f* together with the connection position of the first individual channel 12 with respect to the first common channel 20. Further, when viewed on the side surface (viewed on the cross-section), the connection position of the third individual channel 216 with respect to the first common channel 20 is for example the same as the connection position of the third individual channel 16 with respect to the second common channel 24 in the first embodiment. That is, the opening 216*a* on the first common channel 20 side of the third individual channel 216 is opened in the side surface of the first common channel 20.

Note that, in the present embodiment, unlike the first embodiment, the third individual channel 216 is one example of the second channel, and the second individual channel 214 is one example of the third channel.

Figure 16B:
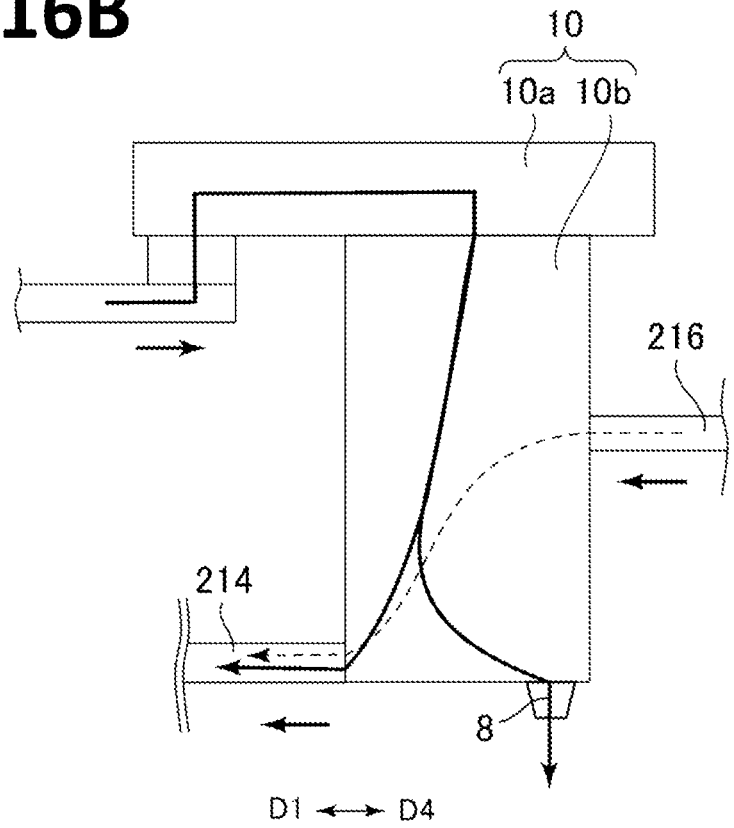
FIG. 16B is a conceptual view showing the flow of a fluid inside a liquid ejection unit according to the second embodiment.

FIG. 16B is a conceptual view showing the flow of the fluid inside the ejection unit 215 and corresponds to FIG. 9 for the first embodiment. In the figure, in the same way as FIG. 9, the actual flow of liquid is indicated by the solid lines, while the flow of the liquid supplied from the third individual channel 216 is indicated by the dashed line.

When viewed on a plane, the liquid is supplied to the ejection unit 215 from the two sides of the first direction D1 and fourth direction D4. For this reason, the supplied liquid has a velocity component of the first direction D1 and a velocity component of the fourth direction D4. Therefore, the liquid supplied to the pressurizing chamber 10 agitates the liquid inside the partial channel 10*b*. As a result, the possibility of generation of a region where the liquid pools inside the partial channel 10*b* can be reduced.

Further, the second individual channel 214 is connected to the first direction D1 side of the partial channel 10*b*, while the third individual channel 216 is connected to the fourth direction D4 side of the partial channel 10*b*. For this reason, the liquid supplied from the third individual channel 216 ends up flowing from the fourth direction D4 to the first direction D1 so as to transverse the internal portion of the partial channel 10*b*. As a result, the possibility of generation of a region where the liquid pools inside the partial channel 10*b* can be reduced.

In the present embodiment having such a configuration as well, in the same way as the first embodiment, in each ejection unit 215, the first channel (first individual channel 12) and second channel (third individual channel 216) are individually connected to two positions in the first common channel 20 which sandwich at least one second portion 20*f* between them, therefore a pressure wave generated in the pressurizing chamber 10 is kept from returning to the pressurizing chamber 10 through the first channel, first common channel 20, and second channel.

(Angles of Individual Channels in Each Ejection Unit)

Assume the direction which the opening of the first individual channel 12 on the first common channel 20 side faces is "d1". Further, assume the direction which the opening 216*a* of the third individual channel 216 on the first common channel 20 side faces is "d2". As shown on the bottom right in FIG. 16A, assume the angle formed by these two directions is θ. In more detail, for example, if d1 and d2 are moved from the positions of the openings 12*a* and 216*a* parallel to each other and are made approach each other, they will fall into one plane, therefore the angle formed on that one plane may be defined as θ.

At this time, the angle θ is for example 135 degrees or less. In this case, for example, compared with the case of the angle exceeding 130 degrees, the concern over the pressure wave from one opening to the other opening not being reflected, but reaching it is reduced. Further, for example, the area (expansion) of the other opening when viewed from one opening becomes smaller, therefore it becomes harder for the pressure wave to enter into the other opening.

Further, the angle θ is for example 45 degrees or more. In this case, for example, compared with the case of less than 45 degrees, the concern over the pressure wave transferred from one opening to the first common channel 20 being reflected one time at the inner surface of the first common channel 20 facing the one opening and entering into the other opening is reduced.

Note that, in the shown example, the angle is 90 degrees. In this case, the area of the other opening viewed from one opening becomes the smallest, therefore the concern over the pressure wave being directly propagated from one opening to the other opening or being propagated by one reflection is reduced.

As explained above, when viewed on a plane, the connection position of the third individual channel 216 with respect to the first common channel 20 may be the same as the connection position of the second individual channel 14 with respect to the first channel 20 in the first embodiment. Therefore, in the present embodiment, the lengths of the opening 12*a* and the opening 216*a* in the channel direction of the first common channel 20 are equal to L0 shown in FIG. 12. On the other hand, the first individual channel 12 is the same as the first individual channel 12 in the first embodiment. Accordingly, the relationship that L0 is equal to L1 or more stands also in the present embodiment.

Further, as explained above, the opening 216*a* of the third individual channel 216 is opened in the side surface of the first common channel 20, therefore the width of the first common channel 20 in the opening 216*a* is L4 shown in FIG. 12. As understood from FIG. 12, L0 is longer than L4. Accordingly, the relationship that L0 is not less than the width of the first common channel 20 at the position of the opening 216*a* stands also in the present embodiment.

The configuration of setting θ to a suitable degree and the configuration of setting L0 etc. to suitable lengths may be suitably combined.

Further, the configuration of setting θ to a suitable degree, the configuration of setting L0 etc. to suitable lengths, and the configuration of providing a portion having a relatively small cross-sectional area in the common channel are more effective in a case as in the first embodiment and second embodiment where a displacement element faces a loop-shaped channel including two individual channels. The reason for this is as follows: If the displacement element faces the loop-shaped channel, there is a concern of the pressure wave exerting an influence upon the pressure applied by the displacement element when ejecting droplets when the pressure wave has passed through the loop-shaped channel and returned back.

Note that, in the first embodiment, the displacement element 48 is arranged so as to face the pressurizing chamber body 10*a* in the loop-shaped channel passing through the pressurizing chamber body 10*a*, partial channel 10*b*, second individual channel 14, first common channel 20, and first individual channel 12 in that order and returning to the pressurizing chamber body 10*a*. In the second embodiment, the displacement element 48 is arranged so as to face the pressurizing chamber body 10*a* in the loop-shaped channel for passing through the pressurizing chamber body 10*a*, partial channel 10*b*, third individual channel 216, first common channel 20, and first individual channel 12 in that order and returning to the pressurizing chamber body 10*a*.

Third Embodiment

Figure 17:
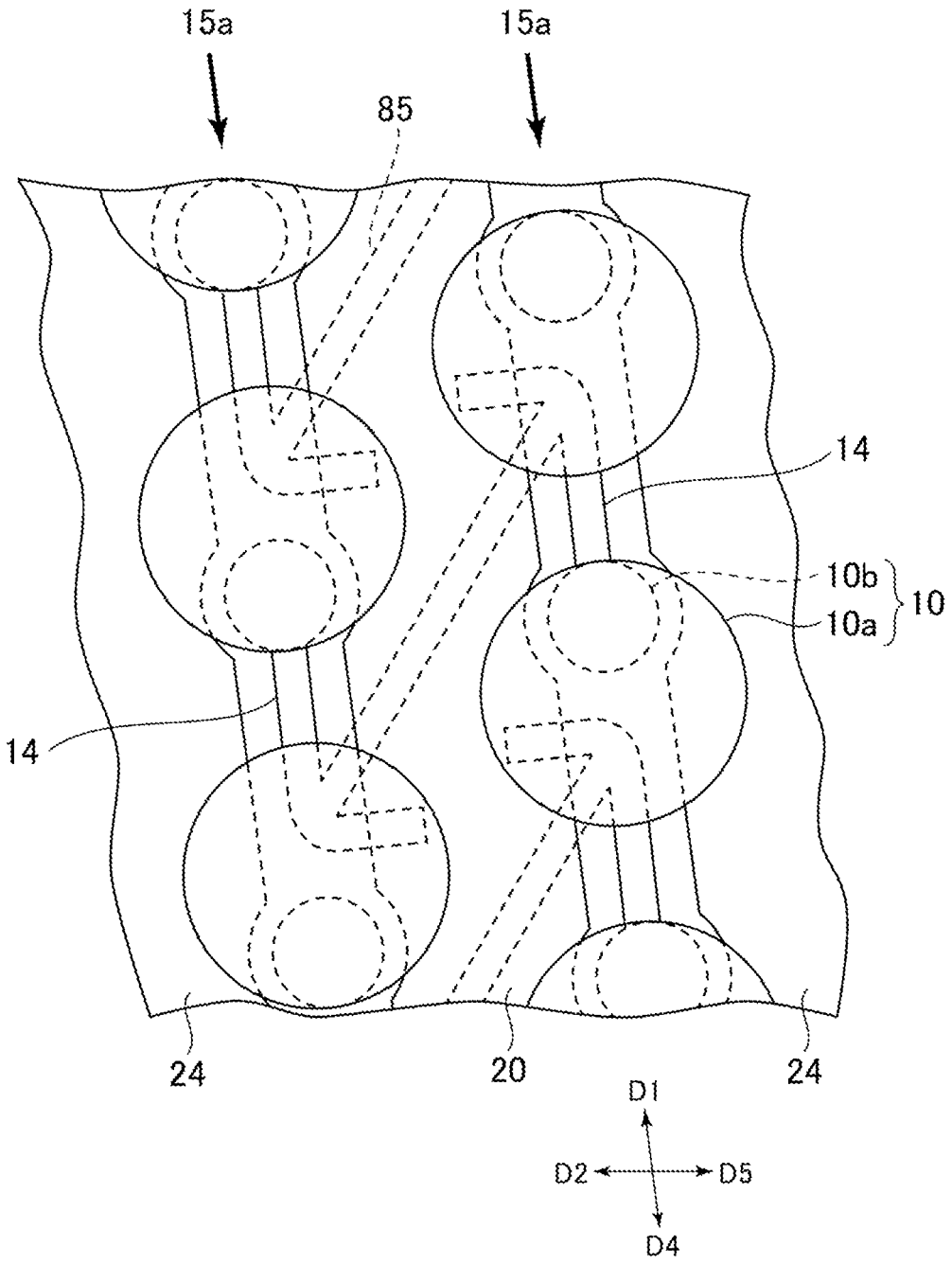
FIG. 17 A plan view showing a portion of a channel according to a third embodiment.

FIG. 17 is a plan view showing a portion of a channel according to a third embodiment. The figure shows only the second individual channels 14 for the individual channels in the same way as FIG. 14 for the first embodiment.

The third embodiment is different from the first embodiment only in the point that communication channels 85 connecting the second individual channels 14 to each other are provided between the ejection unit columns 15*a* adjacent to each other. The configurations other than this are the same as the first embodiment from the overall configuration of the printer up to the shape of the ejection units 15.

The communication channels 85, for example, connects the middles (for example bent portions) of the second individual channels 14 to each other beneath the first common channel 20. If such communication channels 85 are provided, for example, channels dispersing the pressure waves of the second individual channels 14 are configured. The communication channels 85 are formed relatively long by connection to the second individual channels 14 which extend to reverse directions to each other, therefore fluid crosstalk through the second individual channels 14 is relatively small.

First to third embodiments were explained above. However, the art according to the present disclosure is not limited to the above embodiments. Various changes may be made so long as not out of the gist thereof.

For example, as the pressurizing part, an example of pressing a pressurizing chamber 10 by piezoelectric deformation of a piezoelectric actuator was shown, but the pressurizing part is not limited to this. For example, a heat generation part may be provided for each pressurizing chamber 10 to form a pressurizing part which heats the liquid inside the pressurizing chamber 10 by the heat of the heat generation part and performs pressurization by thermal expansion of the liquid.

The preferred connection positions of the first to third individual channels with respect to the common channels do not have to stand for all ejection units. However, preferably, the connection positions stand for all ejection units, all ejection units except those on the two ends in the arrangement of ejection units, or 90% or more of the ejection units.

In the common channel, when ignoring the cyclic change of the cross-sectional area due to the provision of the first portions and second portions, the cross-sectional area may gradually change from one end side toward the other end side. In other words, the plurality of first portions need not have the same cross-sectional areas as each other, or the plurality of second portions need not have the same cross-sectional areas as each other. For example, in the common channel for supplying liquid, the cross-sectional area may become larger from the upstream side to the downstream side.

The second portions or fourth portions are not limited to ones configured by formation of recessed portions which are recessed at the outsides of the channel at the side surfaces of the common channel when viewed on a plane. For example, the second portions or fourth portions may be configured by formation of recessed portions which are recessed at the top surface or bottom surface of the common channel when viewed on a side surface or may be configured by a plate-shaped portion projecting from the side surface, top surface, or bottom surface of the common channel into the channel to cross the channel. Further, in the case where the recessed portions which are recessed on outsides of the channel are formed, portions of the partial channels do not have to be positioned in the recessed portions. Conversely, not only portions of the partial channels, but also the entire partial channels may be positioned in the recessed portions.

REFERENCE SIGNS LIST

1 . . . color inkjet printer
2 . . . liquid ejection head
2*a* . . . head body
4 . . . first channel member
4*a* to 4*m* . . . plates
4-1 . . . pressurizing chamber surface
4-2 . . . ejection hole surface
6 . . . second channel member
6*a* . . . through hole
6*b*, 6*c* . . . openings
8 . . . ejection hole
8*a* . . . ejection hole column
8*b* . . . ejection hole row
10 . . . pressurizing chamber
10*a* . . . pressurizing chamber body
10*b* . . . partial channel
10*c* . . . pressurizing chamber column
10*d* . . . pressurizing chamber row
11 . . . dummy pressurizing chamber
12 . . . first individual channel (first channel)
14 . . . second individual channel (second channel)
15 . . . ejection unit
16 . . . third individual channel (third channel)
20 . . . first common channel
20*a* . . . opening
20*e* . . . first portion
20*f* . . . second portion
20*r* . . . first recessed portion
22 . . . first integrating channel
22*a* . . . opening
24 . . . second common channel (fourth channel)
24*a* . . . opening
24*e* . . . third portion
24*f* . . . fourth portion
24*r* . . . second recessed portion
26 . . . second integrating channel
26*a* . . . opening
28 . . . end part channel
28*a* . . . broad-width portion
28*b* . . . narrowed portion
28*c*, 28*d* . . . openings
30 . . . damper
30*a* . . . first damper
30*b* . . . second damper
32 . . . damper chamber
32*a* . . . first damper chamber
32*b* . . . second damper chamber
40 . . . piezoelectric actuator substrate
40*a*, 40*b* . . . piezoelectric ceramic layers
42 . . . common electrode
44 . . . individual electrode
44*a* . . . individual electrode body
44*b* . . . led out electrode
46 . . . connection electrode
48 . . . displacement element
50 . . . housing
50*a*, 50*b*, 50*c* . . . openings
50*d* . . . heat insulation part
52 . . . heat radiation plate
54 . . . circuit board
56 . . . pressing member
58 . . . elastic member
60 . . . signal transmission part
62 . . . driver IC
70 . . . head mounting frame
72 . . . head group
74*a*, 74*b*, 74*c*, 74*d* . . . conveying rollers
76 . . . control part
P . . . recording medium
D1 . . . first direction
D2 . . . second direction
D3 . . . third direction
D4 . . . fourth direction
D5 . . . fifth direction
D6 . . . sixth direction

The invention claimed is:

1. A liquid ejection head comprising:

a channel member comprising:

a first common channel and a second common channel elongated in a first direction and parallel to each other; and a plurality of ejection units aligned along the first and the second common channels, wherein each of the plurality of ejection units comprises:

an ejection hole;

a pressurizing chamber connected to the ejection hole;

a first channel and a second channel each connecting the pressurizing chamber and the first common channel, the first channel comprising a first opening, the second channel comprising a second opening; and a third channel connecting the pressurizing chamber and the second common channel; and a plurality of pressurizing parts that pressurize the plurality of pressurizing chambers, respectively, wherein the first opening is connected to the first common channel and the second opening is connected to the first common channel and is apart from the first opening in the first direction by a distance not less than a width of the first common channel at a position of the first opening.

2. The liquid ejection head according to claim 1, wherein distance is further not less than a width of the first common channel at a position of the second opening.

3. The liquid ejection head according to claim 1, wherein an angle formed by the first opening and the second opening is 135 degrees or less.

4. A liquid ejection head comprising:

a channel member comprising:

a first common channel and a second common channel elongated in a first direction and parallel to each other; and a plurality of ejection units aligned along the first and the second common channels, wherein each of the plurality of ejection units comprises:

an ejection hole;

a pressurizing chamber connected to the ejection hole;

a first channel and a second channel each connecting the pressurizing chamber and the first common channel, the first channel comprising a first opening, the second channel comprising a second opening; and a third channel connecting the pressurizing chamber and the second common channel; and a plurality of pressurizing parts that pressurize the plurality of pressurizing chambers, respectively, wherein the first opening is connected to the first common channel the second opening is connected to the first common channel, and the first opening and the second opening form an angle that is 135 degrees or less.

5. The liquid ejection head according to claim 4, wherein the angle is 45 degrees or more.

6. The liquid ejection head according to claim 1, wherein the first common channel comprises:

a first portion having a first width in a second direction perpendicular to the first direction;

second portion having the first width; and a third portion having a second width in the second direction, and located between the first portion and the second portion, wherein the second width is smaller than the first width, the first opening is disposed at the first portion, and the second opening is disposed at the second portion.

7. A liquid ejection head comprising:

a channel member comprising:

a first common channel and a second common channel elongated in a first direction parallel to each other; and a first ejection unit comprising:

a first ejection hole;

a first pressurizing chamber connected to the first ejection hole;

a first channel and a second channel each connecting the first pressurizing chamber and the first common channel; and a third channel connecting the first pressurizing chamber and the second common channel; and a first pressurizing part that pressurize the first pressurizing chamber, wherein the first common channel, in the first direction, comprises a first portion having a first width in a second direction perpendicular to the first direction, a second portion having the first width, and a third portion having a second width in the second direction, and located between the first portion and the second portion, wherein the second width is smaller than the first width, the first channel connects to the first portion, and the second channel connects to the second portion.

8. The liquid ejection head according to claim 7, wherein the first portion is in contact with the third portion.

9. The liquid ejection head according to claim 7, wherein the second portion is in contact with the third portion.

10. The liquid ejection head according to claim 7, further comprising a second ejection unit that comprises:

a second ejection hole;

a second pressurizing chamber connected to the second ejection hole;

a fourth channel and a fifth channel each connecting the second pressurizing chamber and the first common channel; and a sixth channel connecting the second pressurizing chamber and the second common channel, wherein the fourth channel connects to the second portion.

11. The liquid ejection head according to claim 10, wherein the fifth channel is connected to the second portion.

12. The liquid ejection head according to claim 7, wherein, the first channel comprises a first opening, the first portion is divided into two parts of a first and a second half, the second half is closer to the second portion than the first half, and the first opening is disposed at the first half.

13. The liquid ejection head according to claim 12, wherein the second channel comprises a second opening, the second portion is divided into two parts of a third half and a fourth half, the third half is closer to the first portion than the fourth half, and the second opening is disposed at the fourth half.

14. The liquid ejection head according to claim 7, wherein the second common channel comprises a fourth portion having a third width in a second direction perpendicular to the first direction, a fifth portion having the third width, and a sixth portion having a fourth width in the second direction, being located between the fourth portion and the fifth portion, the fourth width is smaller than the third width, the third channel is connected to the fourth portion.

15. The liquid ejection head according to claim 14, further comprising a second ejection unit that comprises:

a second ejection hole;

a second pressurizing chamber connected to the second ejection hole;

a fourth channel and a fifth channel each connecting the second pressurizing chamber and the first common channel; and a sixth channel connecting the second pressurizing chamber and the second common channel, and the sixth channel is connected to the fifth portion.

16. The liquid ejection head according to claim 7, wherein the first-pressurizing camber comprises a partial channel which extends in a third direction perpendicular to the first and second directions, the third portion comprises a recess, and at least a portion of the partial channel is located in the recess.

17. A recording device comprising:

a liquid ejection head according to claim 1, a conveying part for conveying the recording medium with respect to the liquid ejection head, and a control part controlling the liquid ejection head.

18. A recording device comprising:

a liquid ejection head according to claim 4, a conveying part for conveying the recording medium with respect to the liquid ejection head, and a control part controlling the liquid ejection head.

19. A recording device comprising:

a liquid ejection head according to claim 7, a conveying part for conveying the recording medium with respect to the liquid ejection head, and a control part controlling the liquid ejection head.

20. The liquid ejection head according to claim 1, wherein the first opening and the second opening form an angle that is 135 degrees or less.

* * * * *